US011501629B2

(12) United States Patent
Delgado et al.

(10) Patent No.: US 11,501,629 B2
(45) Date of Patent: Nov. 15, 2022

(54) SYSTEM AND METHOD FOR RESPONDING TO AN ACTIVE SHOOTER

(71) Applicant: Alert Patent Holdings LLC, Jupiter, FL (US)

(72) Inventors: Hector Delgado, Juno Beach, FL (US); Devon Bradley, Juno Beach, FL (US); Adam Smith, Juno Beach, FL (US)

(73) Assignee: ALERT PATENT HOLDINGS LLC, Jupiter, FL (US)

( * ) Notice: Subject to any disclaimer, the term of this patent is extended or adjusted under 35 U.S.C. 154(b) by 0 days.

(21) Appl. No.: 17/027,045

(22) Filed: Sep. 21, 2020

(65) Prior Publication Data

US 2021/0005076 A1 Jan. 7, 2021

Related U.S. Application Data

(63) Continuation-in-part of application No. 16/830,776, filed on Mar. 26, 2020, which is a continuation-in-part of application No. 15/704,872, filed on Sep. 14, 2017, now Pat. No. 10,629,062.

(60) Provisional application No. 62/394,249, filed on Sep. 14, 2016, provisional application No. 62/950,840, filed on Dec. 19, 2019.

(51) Int. Cl.

| | |
|---|---|
| ***G08B 25/01*** | (2006.01) |
| ***G08B 5/36*** | (2006.01) |
| ***G08B 3/10*** | (2006.01) |
| ***G08B 25/10*** | (2006.01) |

(52) U.S. Cl.

CPC ..... *G08B 25/016* (2013.01); *G08B 3/10* (2013.01); *G08B 5/36* (2013.01); *G08B 25/10* (2013.01)

(58) Field of Classification Search

CPC ..... G08B 25/016; G08B 25/10; G08B 3/10; G08B 5/36

See application file for complete search history.

(56) References Cited

U.S. PATENT DOCUMENTS

| | | | | |
|---|---|---|---|---|
| 5,515,419 | A | 5/1996 | Sheffer | |
| 5,736,927 | A | 4/1998 | Sttebbins | |
| 6,072,396 | A * | 6/2000 | Gaukel | B60R 25/102 340/573.4 |
| 6,249,225 | B1 | 6/2001 | Wang | |
| 7,019,646 | B1 * | 3/2006 | Woodard | G08B 17/10 340/539.26 |
| 8,779,919 | B1 | 7/2014 | Darling | |

(Continued)

FOREIGN PATENT DOCUMENTS

| | | |
|---|---|---|
| EP | 2128833 A1 | 12/2009 |
| GB | 2461920 A | 1/2010 |

(Continued)

*Primary Examiner* — Hoi C Lau

(74) *Attorney, Agent, or Firm* — Jennifer Hayes; Nixon Peabody LLP

(57) ABSTRACT

An automated alert system, device and method designed to deliver crisis notifications within seconds to law enforcement personnel. The alert system and method is designed to enhance the response time to an active shooter scenario, thereby minimizing the number of causalities or victims associated with such dangerous scenarios. The system and method uses combination of various hardware components, cellular automation and partnership with first responders to provide an advanced alert system which ensures quick responses.

24 Claims, 21 Drawing Sheets

(56) References Cited

U.S. PATENT DOCUMENTS 9,251,695 B2* 2/2016 McNutt ..... G08B 19/005
9,286,790 B2 3/2016 Lyman
9,514,633 B2* 12/2016 McNutt ..... G08B 25/12
9,514,634 B2* 12/2016 McNutt ..... G08B 19/005
9,564,041 B1 2/2017 Dedeaux
9,679,449 B2 6/2017 Wedig
9,866,703 B2 1/2018 Brown
9,875,643 B1 1/2018 Sarna
9,888,371 B1 2/2018 Jacob
10,020,987 B2 7/2018 Donovan
10,045,187 B1 8/2018 Soleimani
10,587,460 B2 3/2020 Donovan
10,629,062 B2 4/2020 Billig et al.
10,862,744 B2 12/2020 Donovan
11,145,182 B2 10/2021 Delgado et al.
2001/0048364 A1 12/2001 Kalthoff
2002/0095490 A1 7/2002 Barker
2002/0143938 A1* 10/2002 Alexander ..... H04L 67/00 709/224
2003/0025599 A1* 2/2003 Monroe ..... G08B 13/19684 340/531
2003/0062997 A1 4/2003 Naidoo
2004/0004543 A1 1/2004 Faulkner
2004/0086089 A1 5/2004 Naidoo
2004/0155781 A1 8/2004 Deome
2004/0212505 A1 10/2004 Dewing
2005/0001720 A1 1/2005 Mason
2005/0030174 A1 2/2005 Hess
2005/0207487 A1* 9/2005 Monroe ..... G08B 13/19693 375/240.01
2006/0158329 A1 7/2006 Burkley
2006/0195569 A1 8/2006 Barker
2006/0195716 A1 8/2006 Bittner
2007/0072583 A1 3/2007 Barbeau
2007/0103292 A1 5/2007 Burkley
2007/0279214 A1 12/2007 Buehler
2007/0282665 A1* 12/2007 Buehler ..... G06Q 30/0201 705/7.29
2007/0283004 A1 12/2007 Buehler
2008/0166992 A1* 7/2008 Ricordi ..... A61B 5/0002 455/404.2
2008/0214142 A1* 9/2008 Morin ..... G08B 25/016 455/404.2
2009/0096937 A1* 4/2009 Bauer ..... B60R 1/12 348/739
2009/0167862 A1 7/2009 Jentoft
2010/0190468 A1 7/2010 Scott
2010/0261448 A1 10/2010 Peters
2011/0018998 A1 1/2011 Guzik
2011/0111728 A1 5/2011 Ferguson
2011/0140882 A1 6/2011 Jang
2011/0319051 A1* 12/2011 Reitnour ..... H04W 4/029 455/404.2
2012/0003952 A1* 1/2012 Gabriel ..... H04M 11/04 455/404.1
2012/0064855 A1* 3/2012 Mendelson ..... G06Q 90/20 455/404.2
2012/0087482 A1 4/2012 Alexander, Sr.
2012/0092158 A1 4/2012 Kumbhar
2012/0092161 A1 4/2012 West
2012/0162423 A1 6/2012 Xiao
2012/0218102 A1 8/2012 Bivens
2013/0005294 A1* 1/2013 Levinson ..... H04N 7/18 455/404.2
2013/0120133 A1 5/2013 Hicks, III
2013/0141460 A1* 6/2013 Kane-Esrig ..... H04M 3/5116 345/633
2013/0183924 A1* 7/2013 Saigh ..... A61K 31/198 455/404.2
2013/0260825 A1 10/2013 Hagenstad
2014/0002241 A1 1/2014 Elghazzawi
2014/0118140 A1 5/2014 Amis
2014/0120977 A1* 5/2014 Amis ..... H04W 4/90 455/521
2014/0146171 A1* 5/2014 Brady ..... H04N 7/188 348/143
2014/0167969 A1 6/2014 Wedig
2014/0218515 A1 8/2014 Armendariz
2014/0313034 A1 10/2014 Dodson
2014/0361899 A1 12/2014 Layson
2014/0365390 A1 12/2014 Braun
2014/0368601 A1* 12/2014 deCharms ..... H04L 67/26 348/14.02
2014/0368643 A1 12/2014 Siegel
2014/0379801 A1* 12/2014 Gupta ..... H04N 21/25875 709/204
2015/0002293 A1 1/2015 Nepo
2015/0015381 A1* 1/2015 McNutt ..... G08B 19/005 340/287
2015/0015401 A1 1/2015 Wedig
2015/0022347 A1 1/2015 Aswath
2015/0029020 A1 1/2015 Bailey
2015/0038109 A1 2/2015 Salahshour
2015/0087256 A1 3/2015 Carter
2015/0111524 A1 4/2015 South
2015/0112883 A1 4/2015 Orduna
2015/0137967 A1 5/2015 Wedig
2015/0137972 A1 5/2015 Nepo
2015/0170503 A1 6/2015 Wedig
2015/0204109 A1 7/2015 Ergenbright
2015/0208220 A1* 7/2015 Hulan ..... H04W 4/90 455/404.1
2015/0221209 A1 8/2015 Janardhanan
2015/0288797 A1 10/2015 Vincent
2015/0288819 A1 10/2015 Brown
2015/0332580 A1* 11/2015 Bokhary ..... H04W 4/80 340/539.13
2016/0063783 A1 3/2016 Bruns
2016/0086481 A1* 3/2016 McNutt ..... G08B 5/36 340/540
2016/0093197 A1 3/2016 See
2016/0119424 A1 4/2016 Kane
2016/0217679 A1* 7/2016 McNutt ..... G08B 19/005
2016/0232774 A1 8/2016 Noland
2016/0247369 A1 8/2016 Simmons
2016/0373578 A1 12/2016 Klaban
2017/0063616 A1 3/2017 Klemek
2017/0070842 A1* 3/2017 Kulp ..... H04L 67/325
2017/0084166 A1* 3/2017 McNutt ..... G08B 5/36
2017/0223302 A1 8/2017 Conian
2017/0372593 A1 12/2017 Chadwick
2018/0033288 A1* 2/2018 Strack ..... G08B 25/016
2018/0067593 A1 3/2018 Tiwari
2018/0122220 A1* 5/2018 Billig ..... G08B 25/12
2018/0201181 A1 7/2018 Cook
2019/0027032 A1 1/2019 Arunachalam
2019/0122533 A1* 4/2019 McNutt ..... G08B 25/12
2019/0122534 A1* 4/2019 McNutt ..... G08B 21/02
2019/0180660 A1 6/2019 Mosier
2019/0186225 A1 6/2019 Yuasa
2020/0226913 A1* 7/2020 Delgado ..... G08B 15/00
2021/0005076 A1* 1/2021 Delgado ..... G08B 25/016
2021/0280045 A1 9/2021 Delgado et al.

FOREIGN PATENT DOCUMENTS

WO WO 1994/11853 A1 5/1994
WO WO 2001/88872 A1 11/2001

* cited by examiner (CONVENTIONAL ACTIVE SHOOTER SCENARIO)

SYSTEM AND METHOD FOR RESPONDING TO AN ACTIVE SHOOTER

CROSS REFERENCE TO RELATED APPLICATIONS

The present application is a continuation-in-part application of U.S. patent application Ser. No. 16/830,776, entitled "SYSTEM AND METHOD FOR RESPONDING TO AN ACTIVE SHOOTER," filed on Mar. 26, 2020, which is a continuation-in-part application of U.S. patent application Ser. No. 15/704,872, entitled "SYSTEM AND METHOD FOR RESPONDING TO AN ACTIVE SHOOTER," filed on Sep. 14, 2017, now U.S. Pat. No. 10,629,062, which claims priority to U.S. Provisional Patent Application No. 62/394,249, entitled "SYSTEM AND METHOD FOR RESPONDING TO AN ACTIVE SHOOTER", filed on Sep. 14, 2016, the contents of which are hereby incorporated by reference in their entirety.

U.S. patent application Ser. No. 16/830,776 also claims priority to U.S. Provisional Patent Application No. 62/950,840, entitled "SYSTEM AND METHOD FOR RESPONDING TO AN ACTIVE SHOOTER", filed on Dec. 19, 2019, the contents of which are hereby incorporated by reference in their entirety.

FIELD

The present invention relates to security systems and security related methods; to first responder notification systems and methods; and more particularly, to systems and methods for responding to emergency related events, such as an active shooter or other security related occurrences, which requires a response from emergency personnel, such as a law enforcement officer or emergency medical service agent.

BACKGROUND

Active shooter situations, in which an individual actively engages in the killing or attempted killing of people in a confined populated area, are complex situations and difficult for law enforcement agencies to prevent. A U.S. Department of Justice Federal Bureau of Investigation report published in 2013 entitled, "A Study of Active Shooter Incidents in the United States Between 2000 and 2013", indicates that there were an average of 11.4 active shooting events annually. A closer look at the actual numbers per year indicates a higher distribution of the events during the period of 2007 to 2013, 16.4 active shooter events, when compared to the years of 2000 to 2006, where there was an average of 6.4 active shooter events. During that time frame, there were 160 active shooter events resulting in 1,043 wounded, including 486 deaths. The study also indicated that most of the active shooter incidents were rapid, with 60% of those incidents ending prior to police arrival. In fact, most of those incidents ended in five minutes or less.

In 2014 and 2015, there were 20 active shooting incidents each year. The more recent active shooter incidents, such as those carried out in Paris, France or San Bernardino, Calif., seem to indicate that the attacks are evolving into more complex, sophisticated, and more deadly occurrences. Each of these attacks included multiple gunmen, with Paris having 7 to 9 attackers. Moreover, there were indications that such attacks were politically or religiously motivated and possibly funded and sponsored by state terrorism. In 2016, the largest mass shooting occurred in Orlando, where an active shooter occurrence resulted the deaths of 49 individuals, and 50 more wounded. Such trends indicate a need for better police training in order to minimize the number of individual deaths or injuries during an active shooter occurrence.

Most emergency situations require a quick response to best neutralize a dangerous situation. Given the lethality and ability to kill or injury large numbers of people in a short time period, a quick response to active shooter calls is imperative. In fact, the previous plan of delaying entry into an active shooter environment until trained teams of specialty officers arrive, assess the situation, and perform a sweep of the building is believed not to be effective. Getting these teams in place can result in a lot of inherent delay, providing the shooter(s) with more time to accomplish their goal, i.e. inflict more casualties. In addition, law enforcement agencies need the public to be prepared for possible active shooter situations and know how to handle such situations should they arise, including being watchful for active shooter threats. Accordingly, a system and method which allows identification of an active shooter situation and alerts law enforcement agencies quickly so that the law enforcement personnel can arrive at the scene as fast as possible is required.

The present invention attempts to address the need in the art by providing a system and method designed to minimize death or injury resulting from a security related occurrence, such as an active shooter scenario, by decreasing police, or other emergency response agencies, such as fire or medical, response time to an initial active shooter occurrence.

SUMMARY present invention is a proactive automated alert system and method designed to deliver crisis notifications within seconds to end users that are needed to respond to an emergency crisis such as an active shooter, including law enforcement personnel, or other emergency related personnel (fire and medical), or civilians, such as elected officials, and enhance the response time to the emergency service, i.e. an active shooter scenario. The system and method uses combination of various hardware components, cellular automation and partnership with first responders to provide an advanced alert system. While the emergency crisis described throughout the application embodies an active shooter event, the system and methods described herein can be used in other emergency crisis events requiring response from one or more first responders.

As used herein, the term "first responders" refers to individuals from one or more agencies that respond to, or may need to be informed in order to respond to or assist in responding to, an emergency event(s) or other security related occurrence(s) which require an action, including but not limited to federal, state or local law enforcement agencies, fire departments, medical organizations, such as hospitals or other medial related services, or federal, state or local government officials. Such first responders may include, for example, police officer, sheriff, Federal Bureau of Investigation (FBI) agent, U.S. Secret Service agent, U.S. Marshal, Bureau of Alcohol, Tobacco, Firearms, and Explosives (ATF) agent, state coordinators, county coordinators, town coordinators, security guards, harbor police, harbor patrols, firefighters, emergency medical technicians or paramedics, physicians, nurses, homeland security agents, military organizations such as the national guard, federal elected officials, state elected officials, or municipal elected officials.

In an illustrative embodiment, the present invention may include a method of rapidly notifying one or more first responders to respond to an emergency event comprising sending data obtained from an area to be monitored for an emergency event occurrence to a dispatch and monitor station located remote from said area to be monitored for an emergency event occurrence; and sending data from said dispatch and monitor station directly to at least one member of a rapid response network.

In an illustrative embodiment, the present invention may include a system for direct notification to first responders about an emergency event for which action by the first responder is required comprising: a notification control unit configured to receive or send a digital transmittance; a rapid notification unit operatively linked to said notification control unit; a rapid dispatch and monitor station configured to be in operative communication with a rapid response network; said rapid response network comprising at least one electronic device configured to receive and send a message related to said emergency event directly to a first responder.

Accordingly, it is an objective of the invention to provide systems and methods for rapid response to emergency events requiring the attention and response of one or more first responders.

It is an objective of the invention to provide notification systems and methods for rapid response to security related occurrences requiring the attention and response of one or more first responders.

It is yet a further objective of the invention to provide a monitored active shooter tactical immediate response system for the purpose of enhancing the response time to an active shooter scenario.

It is a further objective of the invention to provide a proactive automated alert system designed to deliver crisis notifications within seconds to first responders.

It is a further objective of the invention to provide a proactive automated alert system designed to deliver crisis notifications within seconds to law enforcement personnel.

It is yet another objective of the invention to provide a proactive automated alert method designed to deliver crisis notifications within seconds to law enforcement personnel.

It is a still further objective of the invention to provide a proactive automated alert system designed to enhance the response time to an active shooter scenario.

It is a further objective of the invention to provide a proactive automated alert method designed to enhance the response time to an active shooter scenario.

It is yet another objective of the invention to provide an automated alert system and method designed to deliver crisis notifications within seconds to law enforcement personnel and enhance the response time to an active shooter scenario using cellular technology.

It is a still further objective of the invention provide an automated alert system and method designed to deliver crisis notifications within seconds to law enforcement personnel and enhance the response time to an active shooter scenario using cellular technology and cell phones linked directly to law enforcement personnel.

It is a further objective of the invention to provide a system and method utilizing various hardware components and cellular automation, in partnership with first responders, to provide an advanced, rapid alert system.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
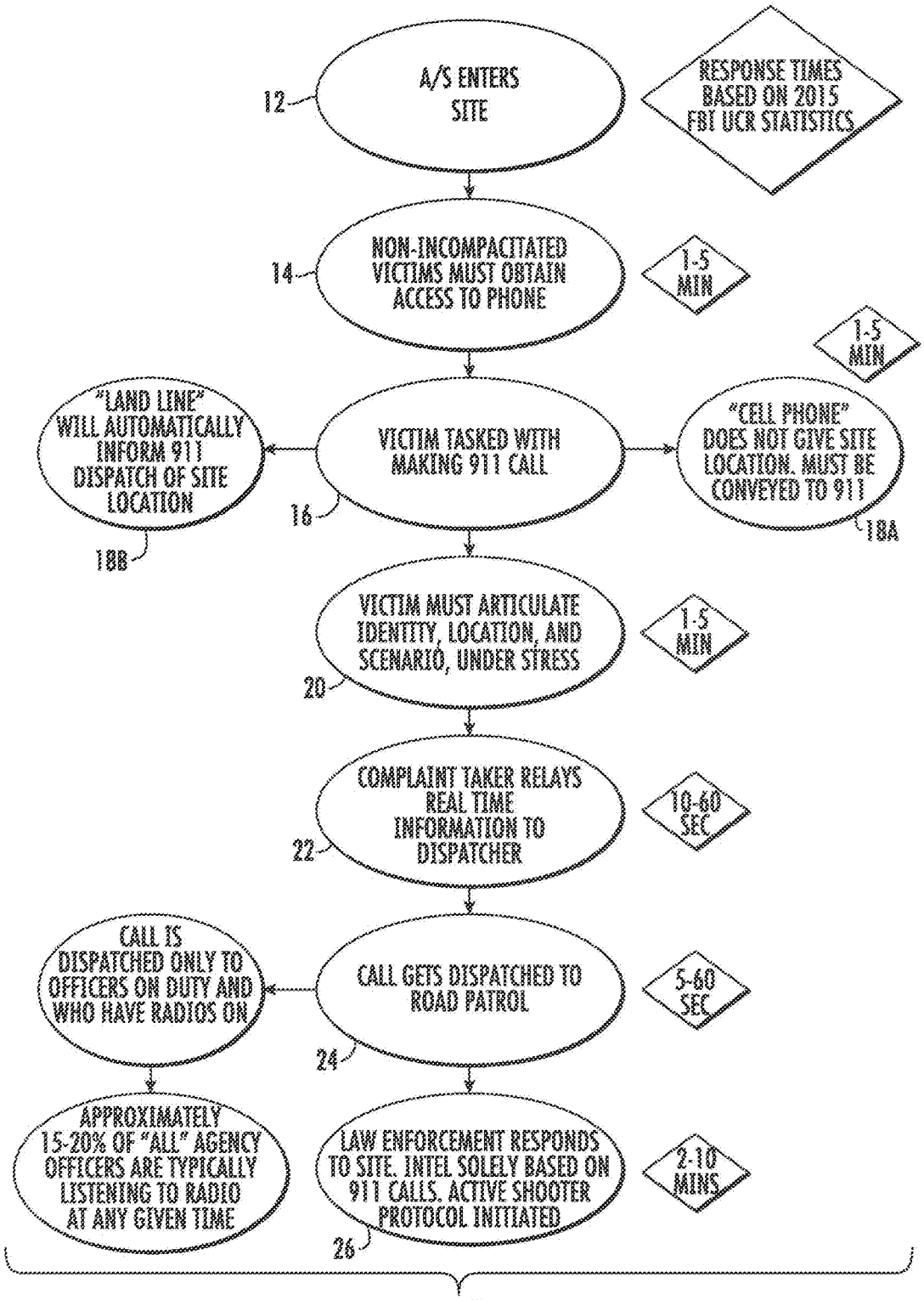
FIG. 1 is a flow chart outlining the steps of a conventional active shooter scenario response.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

The present invention relates to response systems and methods that provide notification to one or more first responder(s) in response to an emergency event or crises, or other security related occurrences, which requires action the one or more first responders. As an illustrative embodiment, the emergency event described herein is an active shooter scenario where an individual(s) is in a location firing a weapon at one or more occupants of that location. As such, the system and or methods are referred to herein as an active shooter response (ASR) system. While the emergency event/crisis embodies an active shooter event and is described as an ASR system, the system and methods described herein can be used in other emergency or security related crises or events requiring response from one or more first responders.

The ASR system provides a method in which an individual victim (a person located in an area where the active shooter is targeting, i.e. shooting, or in the line of fire/shooting) or potential victim (a person located in an area where the active shooter may go to target additional individuals, such as another room, a closet, a bathroom, or other locations within the environment) in an active shooter environment can initiate a series of events that result in rapid first responder, such as law enforcement personnel, notification and response. In addition to the rapid response, law enforcement personnel may obtain basic knowledge as to where the active shooter environment is located.

FIG. 1 illustrates the current response to an active shooter. This type of emergency event/crisis begins when an active shooter (A/S) enters an active shooting environment site, see step 12. The active shooting environment site may be, for example, a commercial business (random person entering the business or as a result of disgruntled employee or other workplace violence), government or municipality building, a mall, a school, a school campus, an entertainment building such as a movie theater, a sporting venue such as a football or baseball stadium, a night club, a hospital, or a transportation center such as an airport or train station, port or port facility, or any infrastructure. In the typical active shooter scenario, the shooter (or shooters) enters the site discharging the ammunition/bullets from his/her gun(s), causing instantaneous chaos, fear and disorientation. The individual causing the chaos, fear and disorientation may have a knife or machete in addition to, or in place of a gun. Individuals who are not immediately injured, or are non-incapacitated, must contact emergency personnel to obtain help, see step 14. Based on FBI Uniform Crime Reporting (UCR) statistics, the response time to make a first call for help from the moment the active shooter scenario commences can be from between 1-5 minutes. Typically, the contact is via phone and a call to 911, see step 16. While most people have cell phones, individuals may not always have them on hand in a work environment; some cell phones fail to give location and it is up to the individual caller to provide such information, see 18A. Use of landlines provides emergency personnel with the specific location of the site, see 18B. However, in addition to finding and using a phone, which could expose the individual to harm if the active shooter sees what is occurring, the caller must articulate to the 911 dispatcher what is happening and where the action is occurring, see step 20. The phone call may not provide the 911 dispatcher with clear information, as the caller may be hurt, disoriented, shocked, or under stress and afraid to be seen by the active shooter. As a result, reporting to a 911 dispatcher can generally take between 1-5 minutes, or longer, to complete.

Once the 911 dispatcher obtains enough information, he/she then relays the information about the active shooter scenario to a law enforcement dispatcher, see step 22. This action generally takes about 10-60 seconds. Once the law enforcement dispatcher obtains the necessary information, that information is passed on to police road patrols for response, see 24. This action generally takes about 5-60 seconds. The call to police road patrols is generally sent only to officers on duty and who have their radios on. It is estimated that approximately 15% to 20% of all agency officers are listening to their radio at any given time. Once the call is sent to road patrols, law enforcement responds to the site. The information they obtained from the 911 call is typically the only information they will receive. Once at the site, an active shooter protocol is initiated, see step 26. This action generally takes about 2-10 minutes.

While the conventional active shooter response scenario described in FIG. 1 provides for law enforcement personnel to arrive at an active shooter scene, the response suffers from several deficiencies. The current conventional response to end active shooter scenarios must be rapid response. This entails that a team of law enforcement personnel arrive at the scene as fast as possible, as waiting even several minutes for all personnel to arrive and amass an entry team can result in additional injuries, or worse, more casualties. In addition to rapid response, knowing the situation law enforcement may face is critical to ending the violence with minimal injuries or fatalities. Once one or more law enforcement personnel arrive at a scene, they do not always have or receive reliable information as to what may be happening inside. Law enforcement personnel must, therefore, enter a dangerous situation somewhat blind to what is happening. This situation is dangerous to the law enforcement personnel as well as any non-shooters remaining in the active shooter environment. While current 911 response systems result in a response measure in minutes, such actions may not be fast enough; and given the chaos created, first responders are often in the dark as to what may actually be occurring, i.e. where the shooter is actually located and what he/she looks like, inside the emergency environment. This is critical because there may be many injuries and it may be difficult for law enforcement to tell the difference between the active shooter and others within the active shooting environment.

Figure 2:
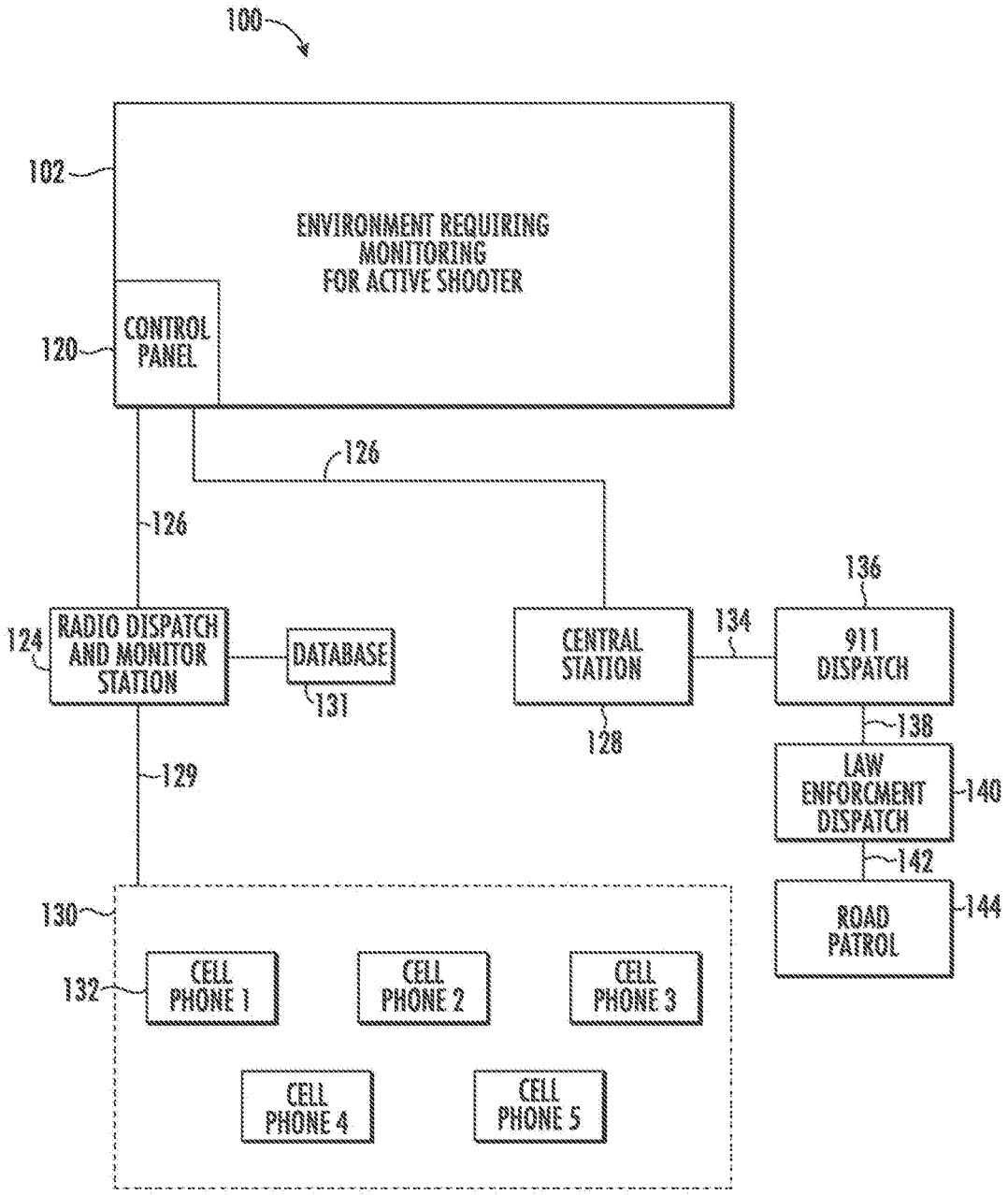
FIG. 2 is a schematic illustration of an embodiment of an active shooter response system in accordance with the present invention.

Referring to FIG. 2, a schematic illustration of an embodiment of an emergency notification response system, referred to generally as active shooter response (ASR) system 100, is illustrated. The active shooter response system 100 contains various hardware components placed at an environment 102 which requires monitoring for an active shooter, as well as other components which are operatively connected to the environment 102 which requires monitoring for an active shooter. Preferably, the operative connection relies on wireless systems and technology, but hardwired systems and technology may be employed. The environment 102 which requires monitoring for an active shooter is illustrated as a business setting having building structure 104, see FIG. 3, housing a plurality of internal offices, referred to generally as 106, and individually as 106A-1061. While the environment 102 which requires monitoring for an active shooter is illustrated as a commercial business structure, other environments such as a school, federal or state government building, a school campus, a night club, restaurant, a sports arena, a movie theater, a music venue, or any other environment that contains people may be used.

An all-purpose room 108 may provide a place for individuals within the company to eat, socialize, or just relax. Offices 106 and the all-purpose room 108 (designated as the inner portion of the inside of the building) may be separated from the entrance 110 of the building 104 via a wall 112

(defined as the outer portion of the inside of the building). Individuals located within the offices 106 are accessible by an internal building door 114. To monitor who enters in and out of the building structure 104, a front desk 116 is placed in the outer portion of the inside the building.

Positioned under the front desk 116 is a rapid notification unit, illustrated herein as a panic button 118. The panic button 118 is operatively connected to a control panel 120. Preferably, the panic button 118 is operatively linked, 122, to the control panel 120 through wireless technology. The wireless technology may be, for example, cellular GSM (Global System for Mobile Communications) communications or other cellular communications, such as, for example CDMA, LTE, 2G, 3G, 4G, and 5G communications. However, wired technology can link the panic button 118 to the control panel 120. In either case, should a user activate the panic button 118, several actions will begin. First, the control panel 120 can be programmed to receive a signal, i.e. from the panic button 118, and notify a rapid dispatch and monitor station or agency 124 through a linked, wireless or wired connection 126 and/or a secondary central station 128. The rapid dispatch and monitor station or agency 124 is linked 129 to a rapid response system network 130 comprising of one or more electronic devices capable of receiving, processing, or displaying said data of one or more first responders 132. The electronic devices could be, for example, smart cell phones (mobile personal computer with a mobile operating system with features useful for mobile or handheld use; smartphones typically have the ability to place and receive voice/video calls and create and receive text messages, have a note-taking application, an event calendar, media player, video games, GPS navigation, digital camera and video camera; smartphones are designed to access the Internet through cellular frequencies or Wi-Fi and can run a variety of third-party software components, such as "apps"; they typically have a color display with a graphical user interface that covers the front surface, the display may be a touchscreen that enables the user to use a virtual keyboard to type words, numbers, and other characters, and press onscreen icons to activate "app" features) or computer tablets. The secondary central station 128 is linked 134 to a 911 dispatcher 136; the 911 dispatcher 136 being linked 138 to a law enforcement dispatch 140, i.e. a local municipality police department. The law enforcement dispatch 140 is linked 142 to one or more road patrol police cars or units 144.

The rapid dispatch and monitor station or agency 124 may be, for example, a remote location that has the hardware (electronic devices such as computers with software systems and databases) configured for receiving and processing all the data received from the one or more components (either from the control panel 120 or directly from each of the individual components) of the active shooter response system 100. The hardware is also configured for transmitting such data to the rapid response system network 130 and, ultimately, to the one or more first responders 132.

Figure 3:
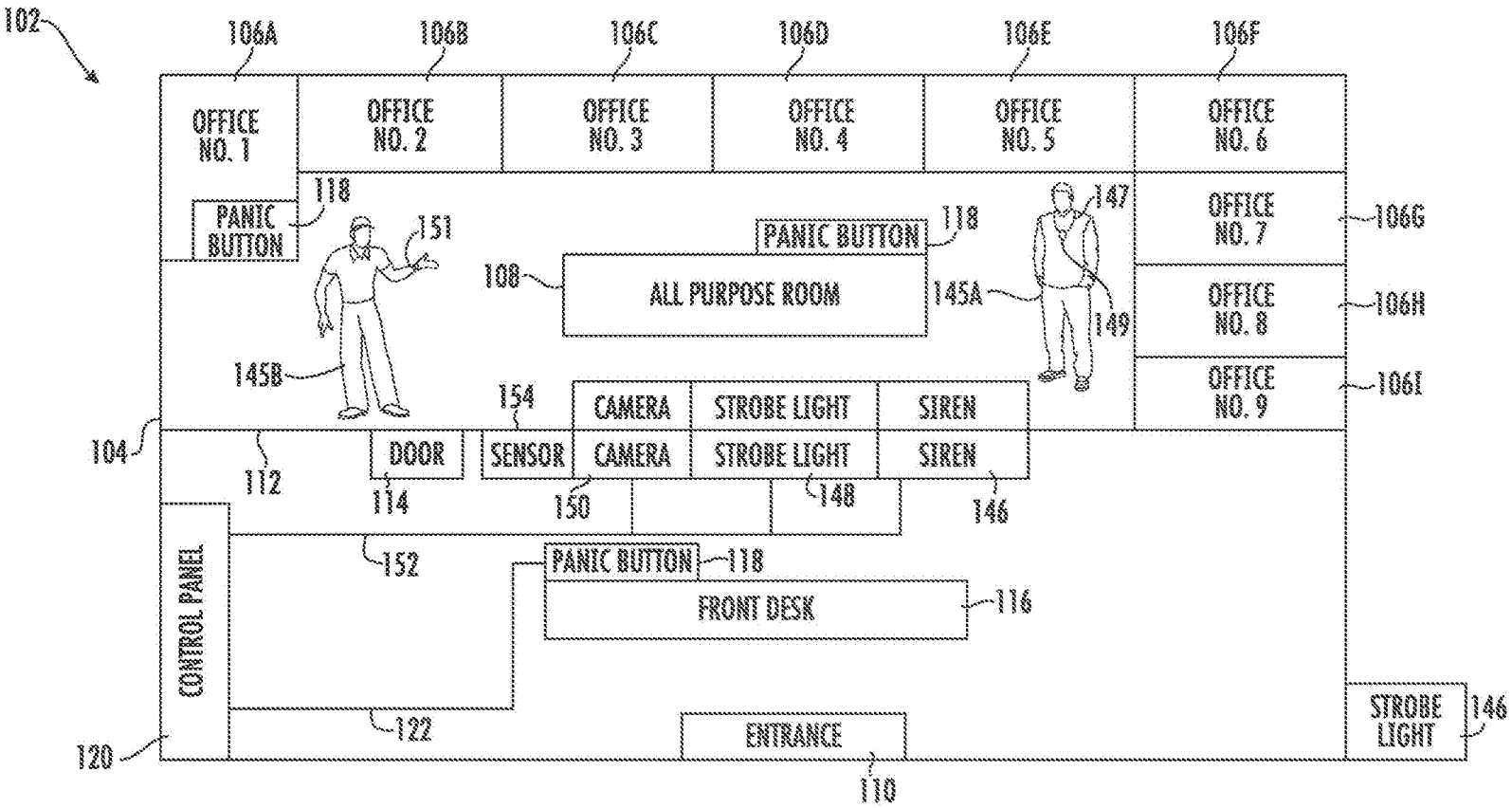
FIG. 3 is an illustrative embodiment of an environment that requires monitoring for an active shooter.

In addition to providing notification to various agencies that form the active shooter response system 100, activation of the panic button 118 may also activate additional hardware components. The active shooter response system 100 may also include an audible device 146, visual indicator device 148, or an image capture device 150 connected 152, wirelessly or wired, to the control panel 120. The audible device 146 may be an audible alarm or siren that produces a noise to alert those inside, as well as outside, the building 104 of a danger. The siren can be programmed to use different sounds or different sound levels. Once one siren is activated, any other siren within the building 104 or associated with the active shooter response system 100 may be triggered. In this manner, should an active shooter begin in one part of a building, i.e., the fourth floor, workers in other parts of the building, for example the third floor or cafeteria, will be alerted of the situation via the siren. The visual indicator device 148 may be a strobe light, such as a blue strobe light designed to disorientate the active shooter and provide notification to a person approaching the building from the outside of the active shooter scenario. In order to disorient the active shooter, the strobe light can be configured to provide flicker vertigo, or the Bucha effect, which causes an imbalance in brain-cell activity as a result of the exposure to low-frequency flickering (or flashing) of a relatively bright light. The image capture device 150 is preferably a camera. A motion sensor (or an infrared motion detector with data/image capture capability) 154 allows the camera to take a still picture upon motion within the room. As shown in FIG. 3, the audible device 146, visual indicator device 148, or an image capture device 150 may be placed on wall 112, but facing the interior portion. Alternatively, the audible device 146, visual indicator device 148, or image capture device 150 may be separated and placed in any location within the building 104. Panic buttons 118 may also be placed anywhere within building, such in an office, see Office 1, 106A, or in the all-purpose room 118. In addition, individuals working within the building may have a portable panic button 118 to be worn around their neck or placed in their pockets. As illustrated in FIG. 3, an individual 145A may be wearing lanyard 147 holding a wearable, portable panic button 149 around the user's neck, or an individual 145B may be wearing wearable, portable panic button 151 around his/her wrist, similar to a watch.

Figure 4:
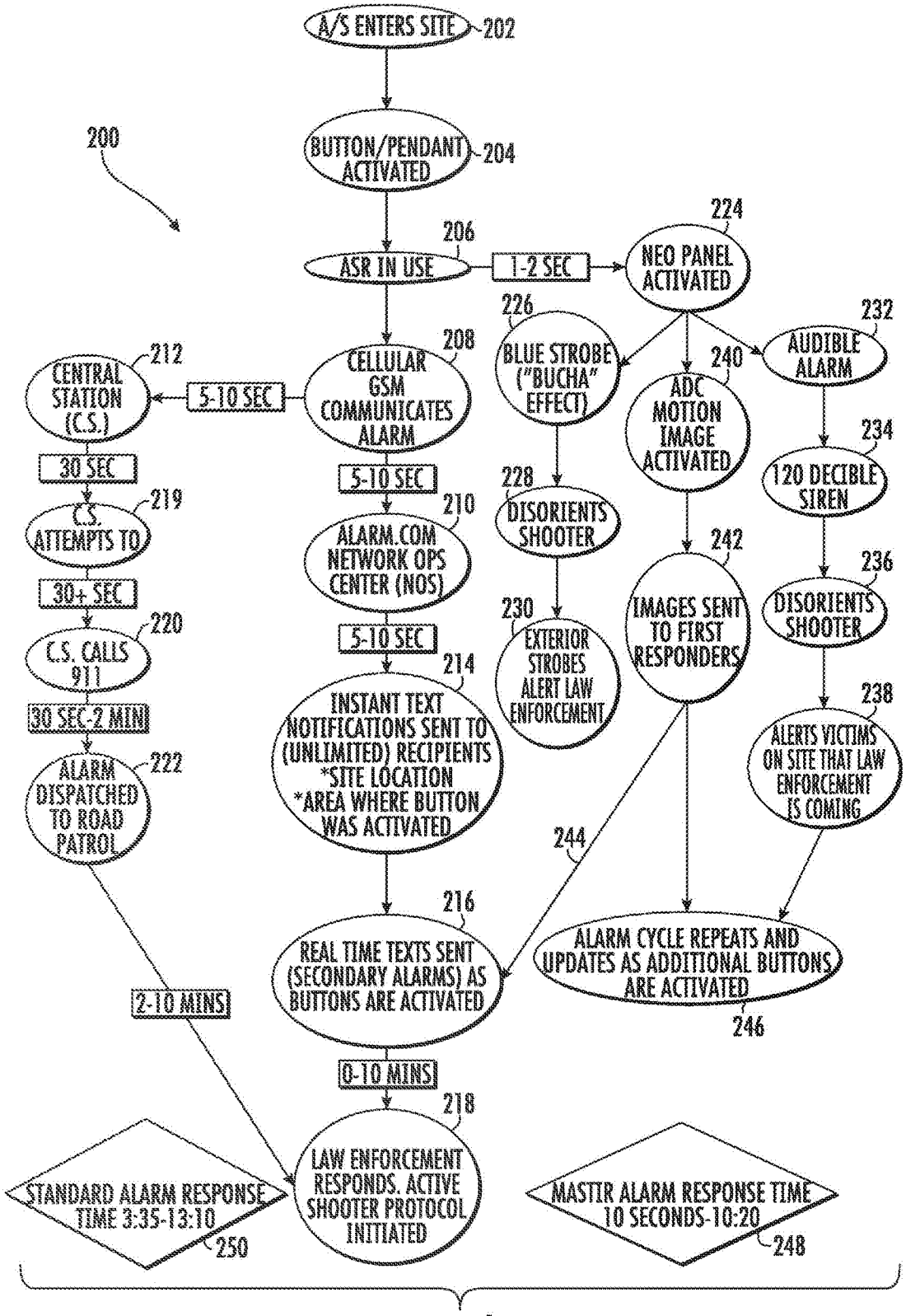
FIG. 4 is a flow chart of an illustrative embodiment of an active shooter tactical response method for responding to an active shooter environment in accordance with the present invention.

FIG. 4 shows an illustrative embodiment of an active shooter response method, referred to generally as a method for rapid response to an active shooter scenario 200, for responding an active shooter environment. As with a conventional response to an active shooter, the method for rapid response to an active shooter scenario 200 begins with an active shooter entering a site, 202. The site contains all the necessary components of the active shooter immediate response system 100, such as described in FIGS. 2 and 3. In the illustrative example, an active shooter enters building 104. As the active shooter enters building 104, a company worker sees the situation and activates the panic button 118, see step 204. Activation of the panic button 118 begins the active shooter response method. The panic button 118 wirelessly communicates with control panel 120. The control panel 120 sends a wireless communication, see step 208, to a rapid dispatch and monitor station 124, see step 210, and to a secondary central monitoring station 128, see step 212. In a preferred embodiment, the signal sent to the rapid dispatch and monitor station 124 or to the secondary central monitoring station 128 is a cellular GSM (Global System for Mobile Communications) network. It will be appreciated that other cellular communication networks may be used including, for example, CDMA, LTE, and other 2G, 3G, 4G and/or 5G communication networks. Alternatively, the panic button may be configured to send a cellular GSM communication or other cellular communication to the rapid dispatch and monitor station 124. The system 100 may use components that utilize Frequency-hopping spread spectrum (FHSS), in which signals are transmitted by rapidly switching carrier among frequency channels. The communications may include one or more of a short message service (SMS), email, a phone call, a push notification or the like. The active shooter response system 100 may be designed to prevent tampering, such as through a crash and smash intrusion. Such system may utilize the system and method described by U.S. Pat. No. 8,395,494, the contents of which are herein incorporated by reference.

The rapid dispatch and monitor station 124 contains a rapid response system 130 for providing a rapid deployment. As an illustrated example, the rapid response system 130 includes a database 131 (see FIG. 2) of cell phone numbers for all law enforcement personnel, such as police officers in predetermined area, predetermined city or municipality, or county. The database 131 may also include email addresses or IP addresses for law enforcement personnel or other electronic devices, such as a tablet, to deliver such information. Once the rapid dispatch and monitor station 124 receives notification, communications through, for example, instant text messages or emails are sent to all personnel in the rapid response system 130, see step 214. Additionally, the rapid dispatch and monitor station 124 may send communications to a tablet at, for example, the 911 dispatch center, a law enforcement office, a police station, a police dispatch center, a site security office, Public Safety Answering Points (PSAPS), and/or the like, as discussed in further detail hereinafter. Accordingly, all law enforcement would receive a notice that there was an active shooter scenario at building 104. To ensure the law enforcement get to the proper place, emergency environment information, such as the site address, as well as the location within the building 104 where the panic button was activated, is provided to the responding law enforcement. As additional panic buttons 118 are pressed, the cell phones of the law enforcement personnel, which form the rapid response system 130, are notified via text or email, preferably in real time, see step 216. All law enforcement personnel seeing the text or email message would then proceed to the building 104 rapidly and activate the active shooter protocol, see step 218.

Figure 5:
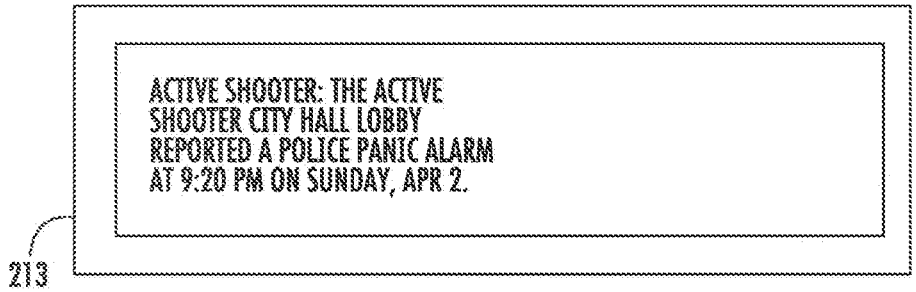
FIG. 5 is a representative screen shot of an illustrative example of the active shooter response method/system communication to a first responder regarding an emergency event.
Figure 6:
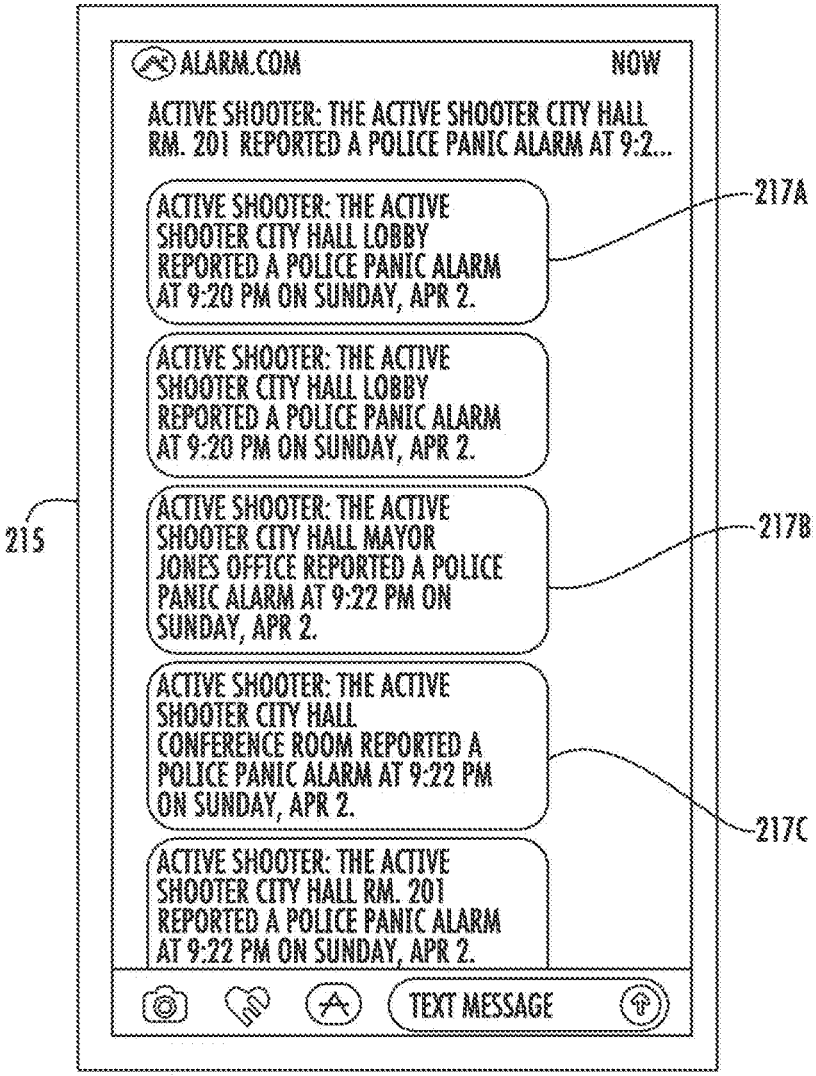
FIG. 6 is a representative screen shot of an illustrative example of the active shooter response method/system communication log to a first responder.

FIG. 5 is an illustrative example of a notification communication 213 a first responder would receive. The notification communication is shown as a text message that would be received by a first responder that is part of the rapid response system 130. The text message is designed to include information that helps the first responder perform his/her job and includes, for example, an indication as to what the incident is, i.e., an active shooter and where the incident is taking place, i.e. at City Hall Lobby. As these incidents tend to be dynamic occurrences and change over time, the first responder may receive a notification communication log 215, see FIG. 6, which includes a plurality of text messages. As shown in FIG. 6, multiple reports about the active shooter has been communicated to the first responder. The first text box 217A indicates the first report of the active shooter at City Hall, via a panic alarm. The third text box 217B indicates that Mayor Jones' office reported the active shooter at City hall. This may indicate that the shooter has moved from the lobby to the location near the Mayor's office. Text block 217C indicates a third report of the active shooter from the City Hall Conference Room.

Once the secondary central station 128 receives the cellular GSM communication or other cellular communication, the central station 128 attempts to contact customer/site first 219, and then calls the 911 dispatcher, see step 220. The 911 dispatcher sends a message to the local law enforcement dispatcher, who then messages road patrols, see step 222. The road patrols notified may proceed to the building 104 rapidly, and activate the active shooter protocol, see step 218.

While individual law enforcement officers are being notified of an active shooter scenario based on the activation of the panic button 118, the control panel 120 is active to perform additional functions, see step 224. The control panel 120 activates the use of the strobe light 148, see step 226. The strobe light 148 is designed to provide a light, preferably blue light, at a wavelength that can disorient the active shooter, see step 228, and provide external notification (strobe light placed on the exterior of the building) to alert law enforcement of the danger as they approach the building. The strobe light may also provide notification to those occupants that are inside of the building, but not at the location where the incident occurred. This would allow those individuals an opportunity to escape the building 104 or move to a remote, safe location inside of the building.

In addition to the activation of a strobe light, an audible alarm 146 is triggered, see step 232. The audible alarm 146 can be a siren set at a particular decibel level, such as 120 decibels, see 234. The decibel level can be set at a particular level designed to disorient the active shooter, 236. The activation of the audible alarm 146 also alerts the individuals on site that there is an active shooter and that law enforcement has been notified and is in route, 238.

Activation of the panic button 118 may also trigger the use of camera 150. Upon activation, the camera may provide a photograph, or multiple photographs, of the situation. The camera may be coupled to a motion sensor so that, upon triggering of the panic button 118 and detection of motion, i.e. movement of the active shooter, photographs are taken, see 240. Any photographs taken by camera 150 are sent to law enforcement personnel or other first responders, see 242. Images may be sent to a police station directly, 244, and to the cell phones of the law enforcement personnel that form the rapid response system 130. The camera 150 may also be configured to provide real time or live images to first responders or provide first responders with videotaped recordings of any action, i.e. the shooter shooting or moving within a particular area of the building 104, as detected by the motion sensor.

Figure 7:
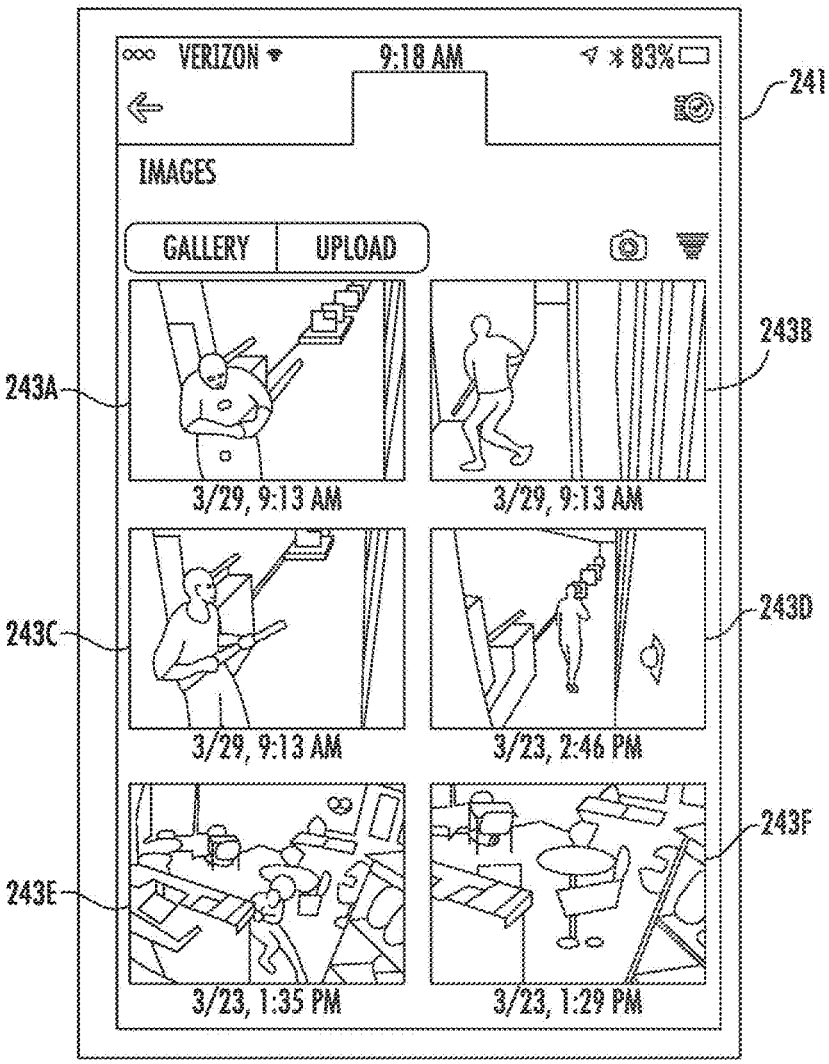
FIG. 7 is an illustrative example of a video log received by a first responder.
Figure 8:
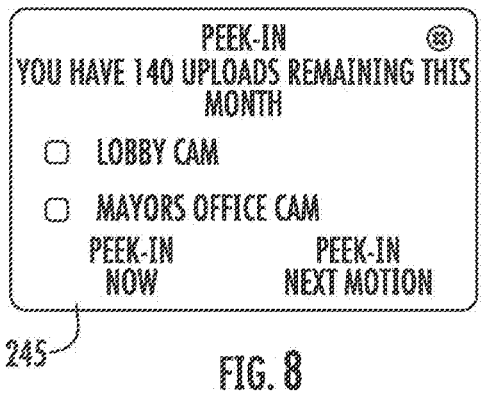
FIG. 8 is a screen shot illustrating a peek-in function.
Figure 9:
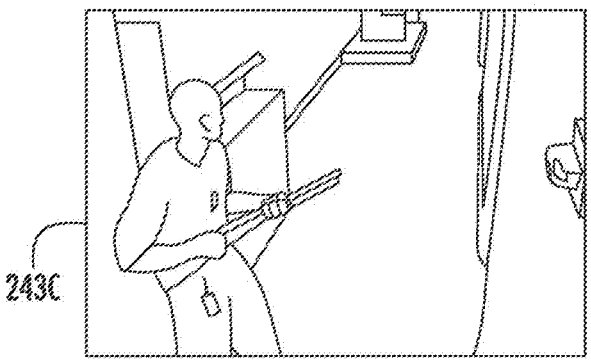
FIG. 9 is a single video image taken from the video log illustrated in FIG. 7.

FIG. 7 is a screen shot of an illustrative embodiment of a video log 241 provided to the first responder as part of the rapid response system 130. The video log 241 provides the first responder with images, 243A-243F obtained from one or more cameras 150 activated as a result of a panic button 18 or sensor activation. Each image may be generated from a specific camera, or the images may be from a single camera. The first responder may be able to see the images as a static image only, as a recorded image showing a predetermined time period. Additionally, the images may allow the first responder to "peek in", access, see FIG. 8, 245, in which case the user is able to view the area shone by the camera in real time, live viewing. FIG. 9 provides a close-up view of image 243C.

As the active shooter moves through the building 104, additional panic buttons 118 may be activated. This allows the alarm cycle to repeat, 246, and updates as the additional buttons are activated. Having the alarm cycle repeat may be important, as it may provide additional images to the law enforcement personnel. More importantly, it may provide responding law enforcement personnel with a more accurate location as to where the active shooter is within the affected environment. As shown in FIG. 4, it is estimated that the current methods will result in a response somewhere between 10 seconds and 10 minutes, 20 seconds 248.

One of the key components of the ASR method and system is the ability to provide rapid and informational notification to individual first responders that form part of the rapid notification unit. This can be critical in various emergency/crisis events. In a case study evaluating the response of an active shooter scenario which resulted in nine deaths, occurring June 2015, at a church near Charleston, S.C., USA, the first unit to arrive on scene occurred 8 plus minutes after the shooting began. A person in the church attempted to call 911 using a cell phone, but was unsuccessful. The first successful call to 911 (from a different individual than the unsuccessful attempt) occurred 5 minutes after the shooter pulled out a weapon and began shooting. Despite an officer being less than one minute from the church when the shooting began, it took eight minutes and eight seconds using the conventional emergency system response for that officer to receive the information and arrive at the site to respond. By that time, the shooting had ended and the shooter escaped. If the church was equipped with the ASR system and methods, it is believed that any person in the church could have activated panic button (such as a wall mounted panic button 118) to begin the notification process. In addition, the first person who attempted to call 911 using a cell phone could have activated portable panic button (see lanyard 147/panic button 149, or watch like panic button 151) rather than attempting to use a damaged phone that was unsuccessful. An audible alarm could have been used to provide sound inside and outside the church and the shooter's comfort zone could have been disrupted by the sirens/strobe. More importantly, a direct text of the incident could have been sent to the officer within 2-10 seconds. In that case, that officer may have been on scene in approximately 1-2 minutes, rather than the 8 plus minutes. In addition, the officer and other first responders may have been notified (more law enforcement agents and paramedics and a local hospital) and also able to review images from an image/motion sensor.

In a second scenario, an individual entered a Florida airport in 2016 and began randomly shooting, killing 5 individuals. First responders were notified of the active shooter via 911 dispatched calls, but only after the shooter had fired all ammunition. Officers in other parts of the airport did not respond because they could not hear the shots being fired. It was determined that there was a law enforcement officer outside the terminal doors of where the shooting took place. He was unable to respond because he did not hear the shots when it began. It was also determined that first responders where confused as to the location of the shooter, and they were actually dispatched to multiple locations due to misinformation. Had the law enforcement officer outside the terminal been directly notified using the ASR system and method, he may have been able to respond within 2-10 seconds.

Figure 10:
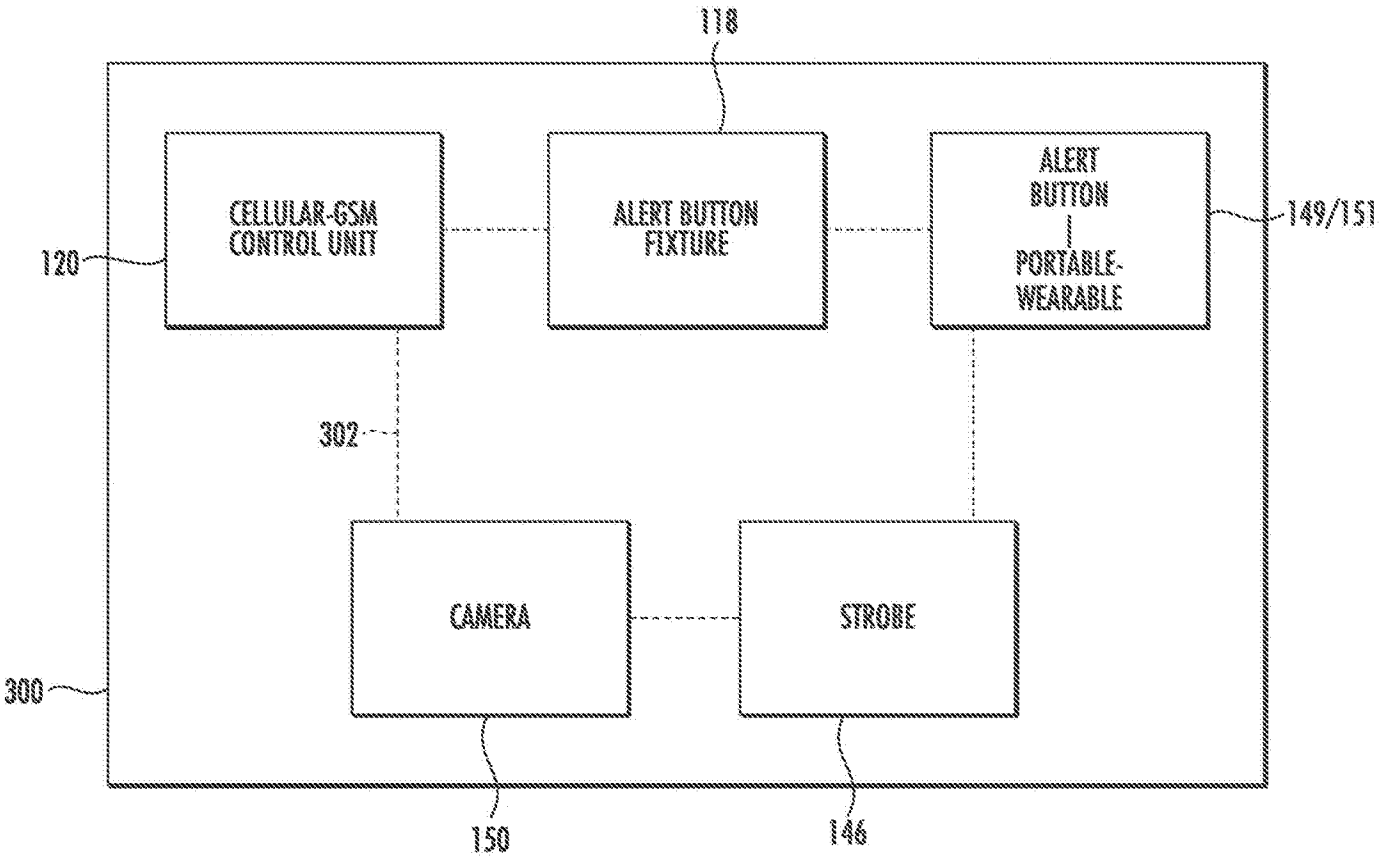
FIG. 10 is a schematic illustration of the components of a portable active shooter response system.

FIG. 10 illustrates a schematic representation of the ASR system 100 shown as a portable system in which one or more individual components are transported in a carrying case 300. The case 300 carries the control panel 120, the siren/strobe light(s) 146, the panic button(s) 118, the portable panic button(s) such as a lanyard 147/panic button 149, or watch like panic button 151, and camera(s) 150. Each of the components are operatively linked together (represented by broken line 302) to function, individually or as a whole system, in any manner as described herein when set up at a site.

Figure 11:
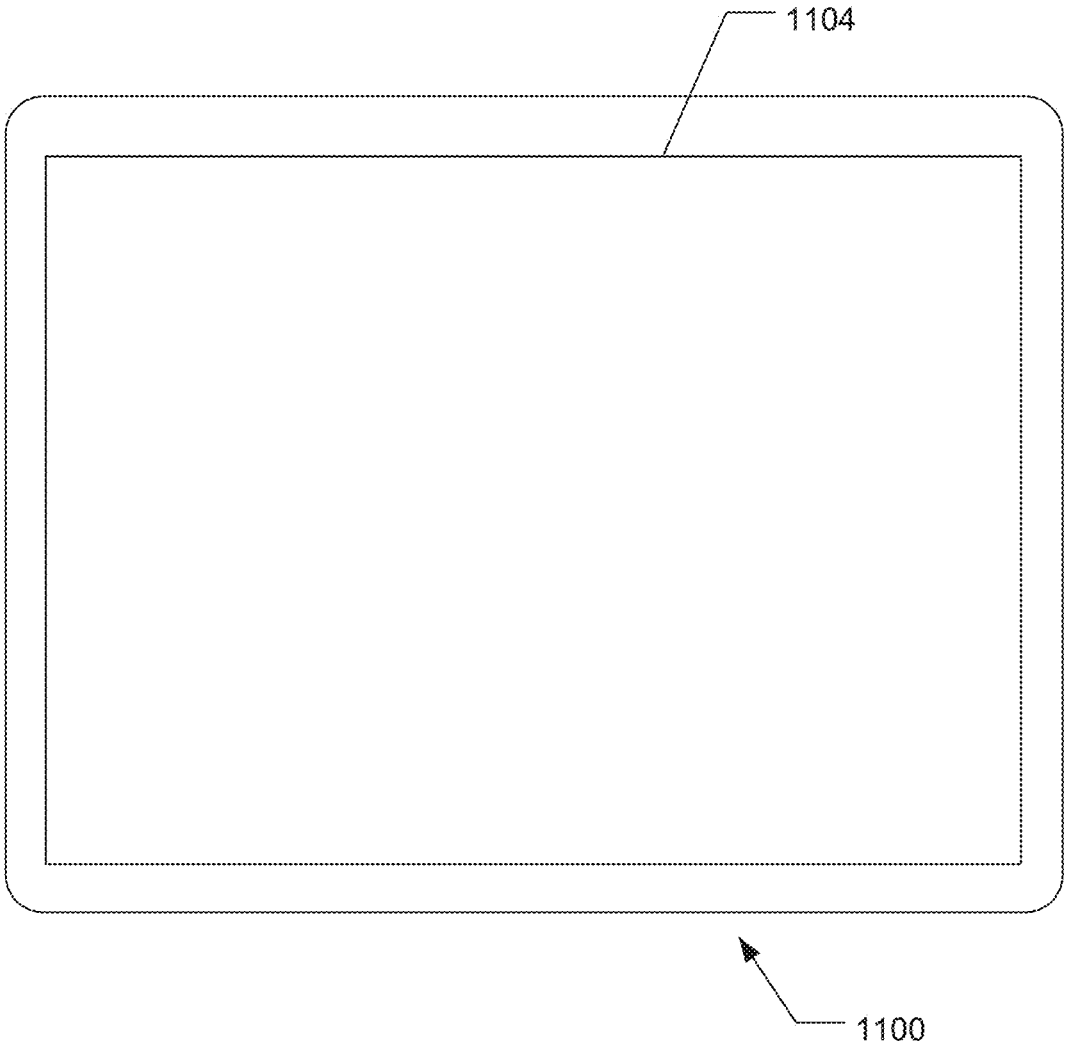
FIG. 11 is a schematic illustration of a dispatch tablet in accordance with one embodiment of the invention.
Figure 12:
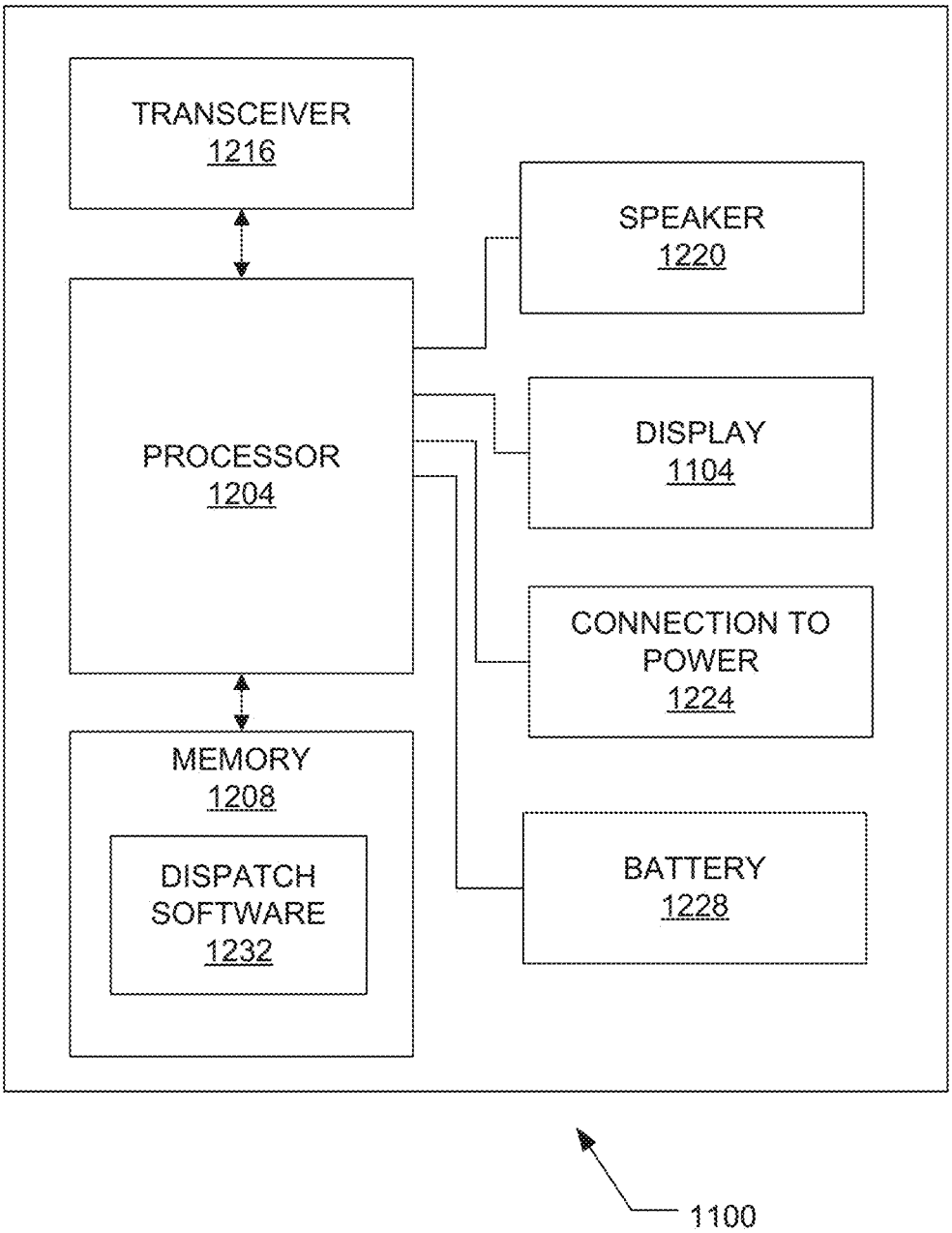
FIG. 12 is an exemplary block diagram of the dispatch tablet.

FIG. 11 schematically illustrates a dispatch tablet in accordance with embodiments of the invention. FIG. 12 is an exemplary block diagram of the dispatch tablet. The tablet 1100 is configured to be a dedicated stand-alone device that can provide instant notification of an incident. The tablet 1100 may be located at, for example, the 911 dispatch center, a law enforcement office, a police station, a police dispatch center, a site security office, Public Safety Answering Points (PSAPS), and/or the like As shown in FIG. 11, the tablet 1100 includes a display 1104. As shown in FIG. 12, the tablet also includes a processor 1204, a memory 1208, a cellular transceiver 1216, a speaker 1220. As shown, for example, in FIG. 12, the cellular transceiver 1216 is coupled to the processor 1204. The memory 1208, speaker 1220 and display 1104 are also coupled to the processor 1204. The display 1104 is also a user interface. The tablet 1100 may further include a connection for an external power supply 1224 and an internal battery 1228. It will be appreciated that the tablet 1100 may include additional components than those illustrated in FIGS. 11 and 12. An exemplary tablet 1100 that may be used is a Lenovo 10.1, Model No. TB-704A.

Because the tablet 1100 includes a cellular transceiver 1216, it is able to communicate over a cellular network and does not require connection to Ethernet. An advantage of using a tablet with a cellular transceiver 1216 is that cellular communications tend to be more secure than Ethernet or other wireless communications and therefore comply with the cyber-security policies of law enforcement agencies.

Figure 13:
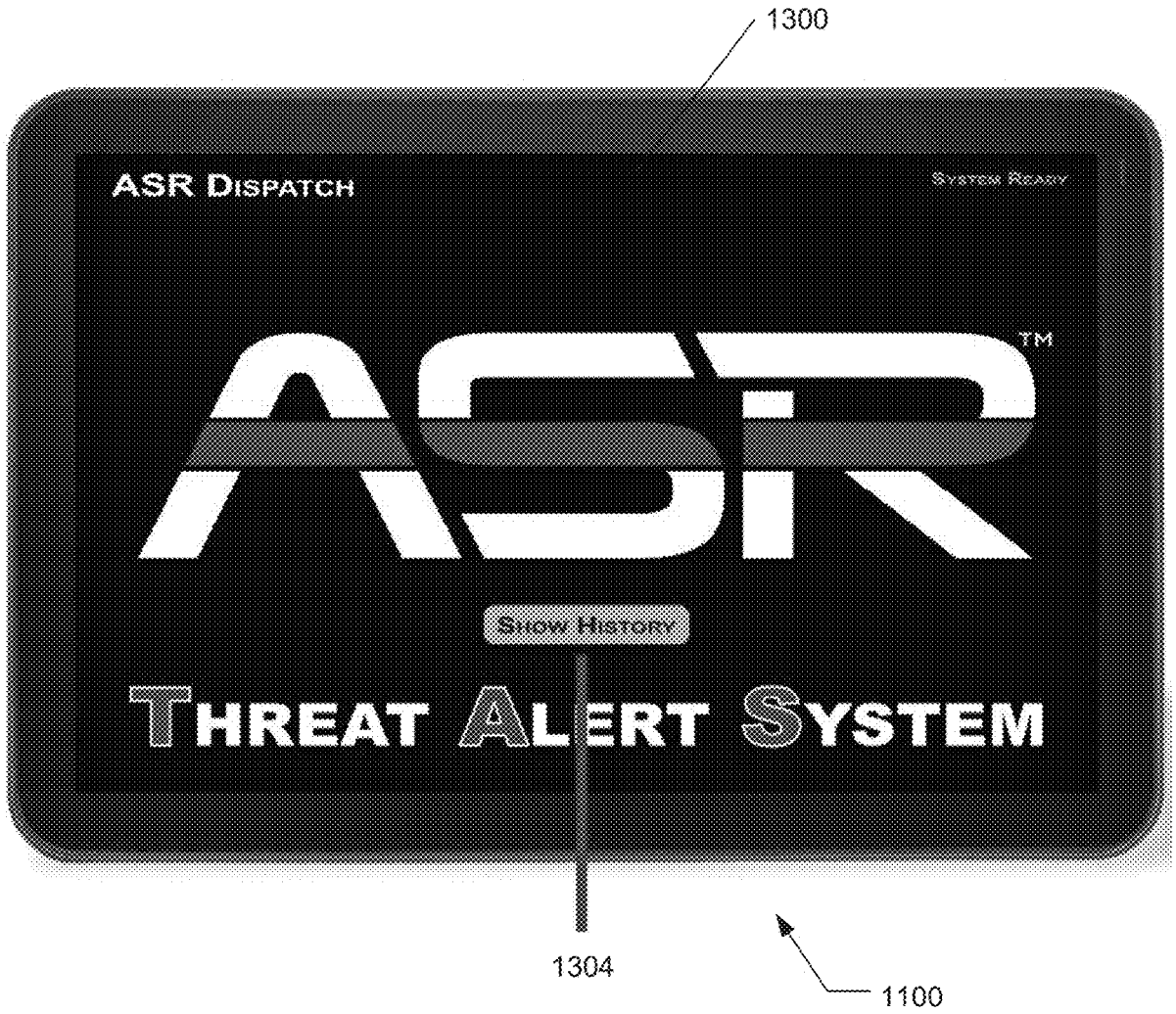
FIG. 13 is an exemplary user interface of a kiosk user screen of the dispatch tablet.

The processor 1204 is configured to operate using only dispatch software 1232 stored in memory 1208 and executed on the processor 1204 so that the tablet 1100 can function as an alert notification system. The tablet 1100 may also be configured such that it cannot be powered off. The tablet 1100 is configured to operate in a kiosk mode when there are no active alarm or emergency events. An exemplary screen shot of the kiosk mode display 1300 is shown in FIG. 13. The tablet 1100 may also be configured such that it cannot be manipulated from the kiosk (locked) screen 1300, i.e., that is only used to run the dispatch software during an alarm or emergency.

Figures 14A, 14B:
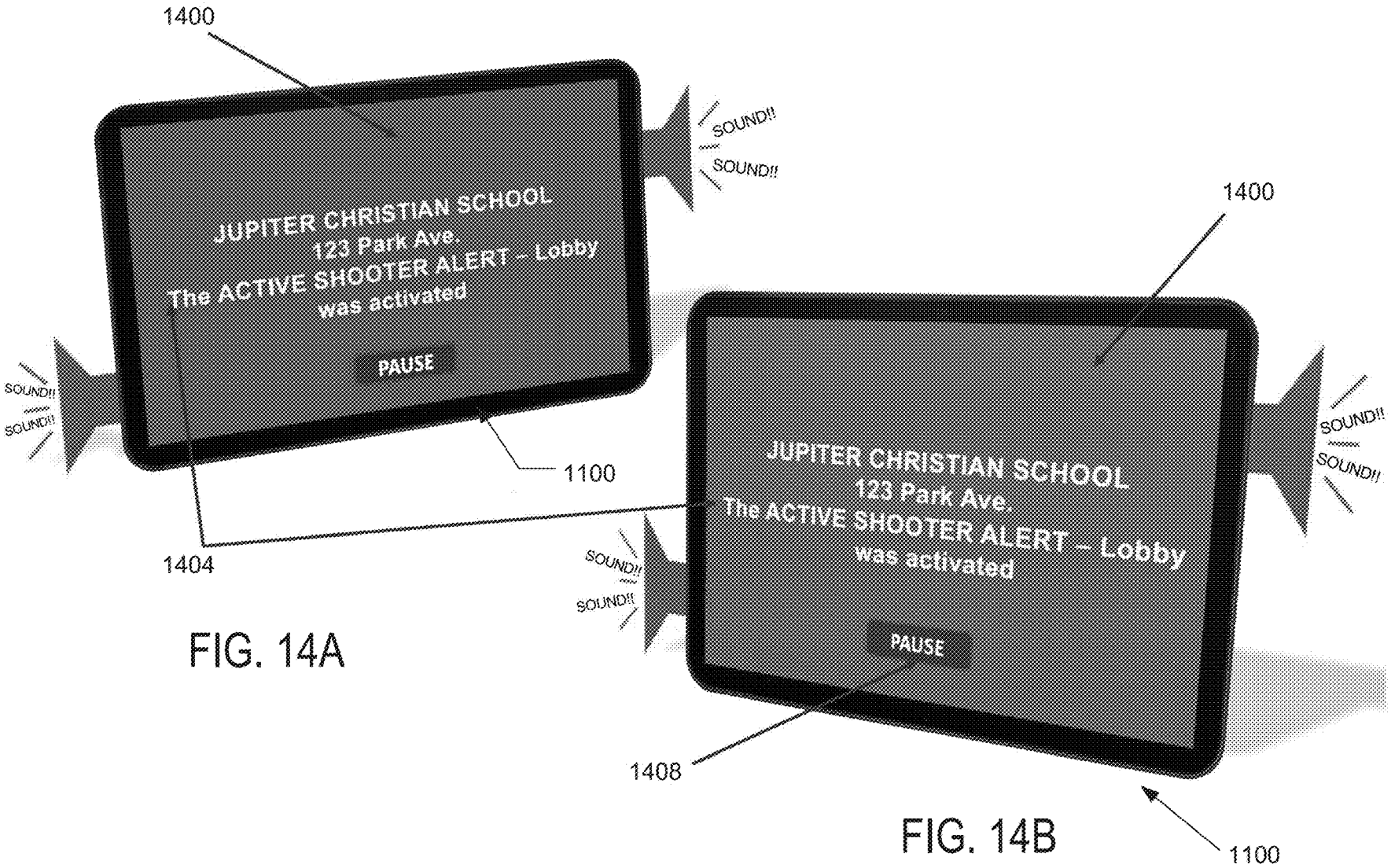
FIGS. 14A-B are exemplary user interfaces of the alarm screens of the dispatch tablet.

In use, the tablet 1100 receives a notification of an alert or alarm event via a cellular communication through the cellular transceiver 1216. That alert or alarm event is provided to the processor 1204 which executes the dispatch software 1232 to generate an audible and visual alert. For example, the speaker 1220 may issue an audible sound corresponding to the audible alert and the display 1104 may display a notification of the alarm or emergency event corresponding to the visual alert. The notification may include text identifying, for example, the location of the incident and other incident information and portions or all of the information received in the notification may be displayed on the tablet's display 1104. For example, the display 1104 may include the location, name, address and description, so that the information can be relayed to first responders. The background color of the display 1104 may also change from the kiosk mode during an alarm event. For example, the background color of the display 1104 in the kiosk mode may be black, but, during an alarm or emergency event, the background color of the display 1104 may alternate between red and blue. Exemplary illustrations of the user interface 1400 of the display during an alert or alarm event are shown in FIGS. 14A-14B. It will be appreciated that the background color of the display 1104 may simply change to red, blue, or any other color (and not alternate), that more than two colors may be used and that the interval in which the screen alternates between the two colors may vary. As shown in FIGS. 14A-B, the user interface 1400 also includes text 1404 describing the alarm or event based on the received notification. As shown in FIGS. 14A-14B, the user interface 1400 may include, a "Return to Home" or "Pause" icon 1408 to silence the audible sound and stop the display from alternating between red and blue but still display the text 1404. If a new alarm notification is received, then the alarm is activated again, i.e., an audible sound is generated and the display is updated to display the notification information and update the background colors, as discussed above. The tablet 1100 allows an operator to dispatches first responders to the location so that they can effectively respond to an incident.

Figure 15:
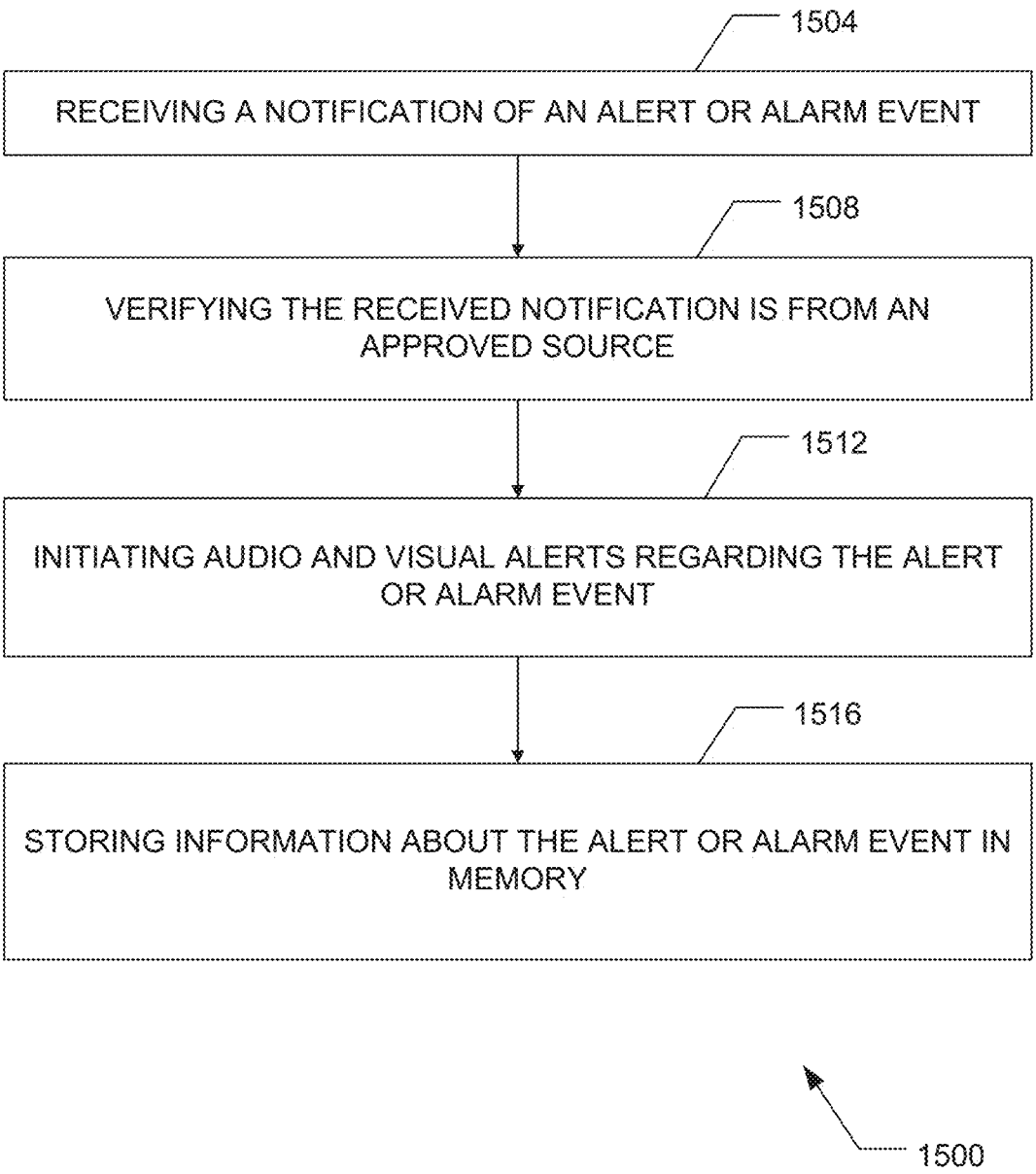
FIG. 15 is an exemplary flow diagram for a process performed by the dispatch tablet.

FIG. 15 is an exemplary flow diagram of a process 1500 performed by the tablet 1100 during an alert or alarm event. As shown in FIG. 15, the process 1500 beings by receiving a notification of an alarm or incident (1504). The notification received at the tablet 1100 may be the same notification received at the remote dispatch and monitor center or central station as discussed above. The tablet may receive the notification directly from the control panel 120 or the remote dispatch and monitor station 124 may deliver the notification to the tablet 1100. In embodiments, where the tablet 1100 receives the notification from the dispatch and monitor station 123, it may receive a subset of the information received at the remote dispatch and monitor station 124 from the control panel 120. In one embodiment, the remote dispatch and monitor station 124 or control panel 120 sends an email to the tablet 1100, which process the email as discussed below.

The process 1500 may continue by verifying that the received notification is from an approved source (1508). For example, the processor may verify that the email address or IP address that sent the notification is on a list of approved sources stored in the memory 1208.

The process continues by initiating audio and visual alerts based on the received notification (1512). In particular, the processor 1204 extracts the information from the notification and generates the audio and visual alerts discussed above. For example, as discussed above, the speaker may issue a sound effect, the original background image may be replaced with full-screen solid-colored images that rapidly alternate in color (e.g., red to blue), and large text may be provided on the display that contains notification details about the alter or alarm.

Figure 16:
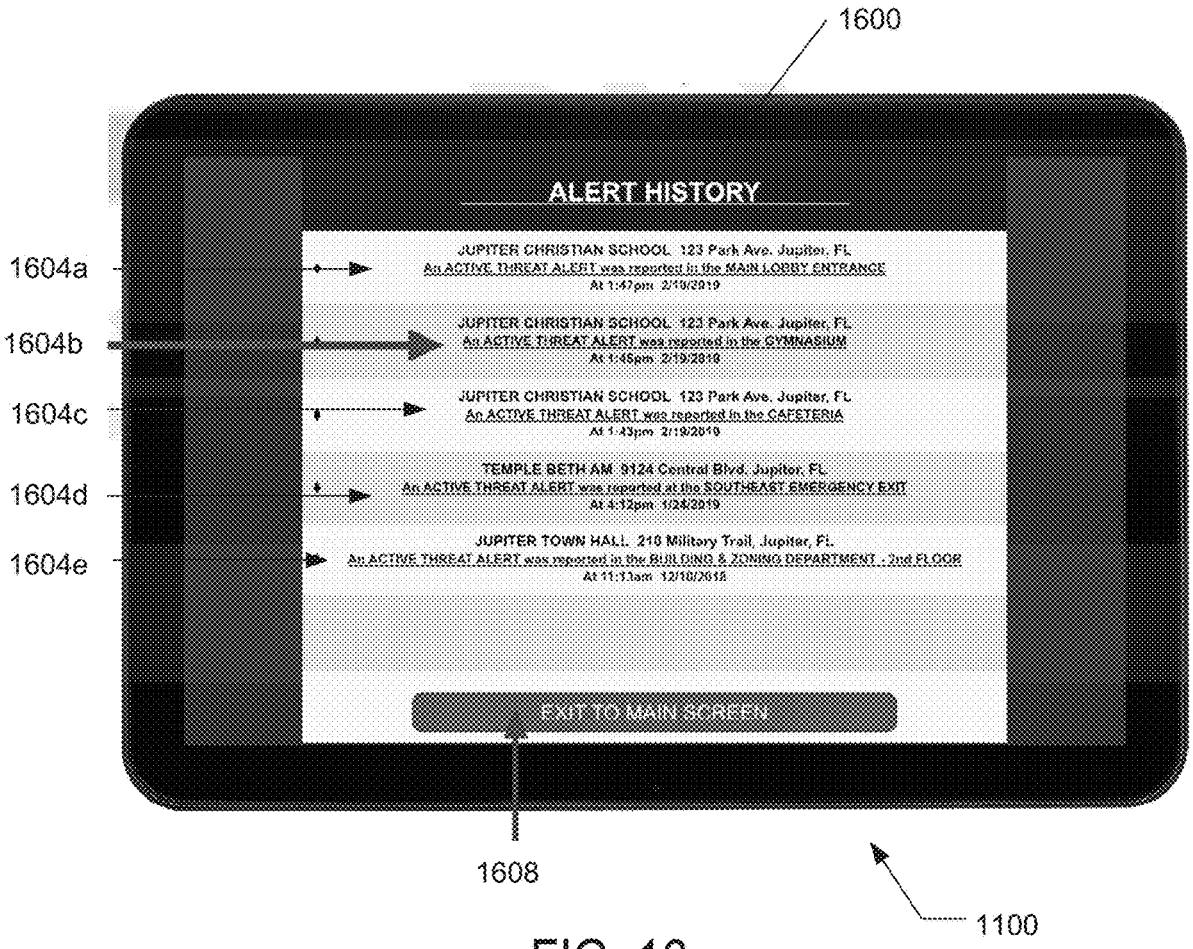
FIG. 16 is an exemplary user interface of the alarm history screen of the dispatch tablet.

The process 1500 may continue by storing information about the alert or alarm in memory (1516). By storing information about the alerts or alarms received at the tablet, it can be used for evidentiary purposes to support criminal investigations and provide accurate timelines about emergency incidents. The information that is stored may include date and time stamps, location information and the like. As shown in FIG. 16, an alert history screen 1600 can be displayed that includes incident history details based on the stored information. In FIG. 16, the incidents 1604*a-e* are listed in chronological order with date/time stamps. In FIG. 16, an icon ("EXIT TO MAIN SCREEN") 1608 is also provided in the alert history screen 1600 to return to the kiosk mode display 1300. In one embodiment, the alert history screen is accessed from the kiosk mode display 1300, shown in FIG. 13, by selection of icon 1304.

Figure 17:
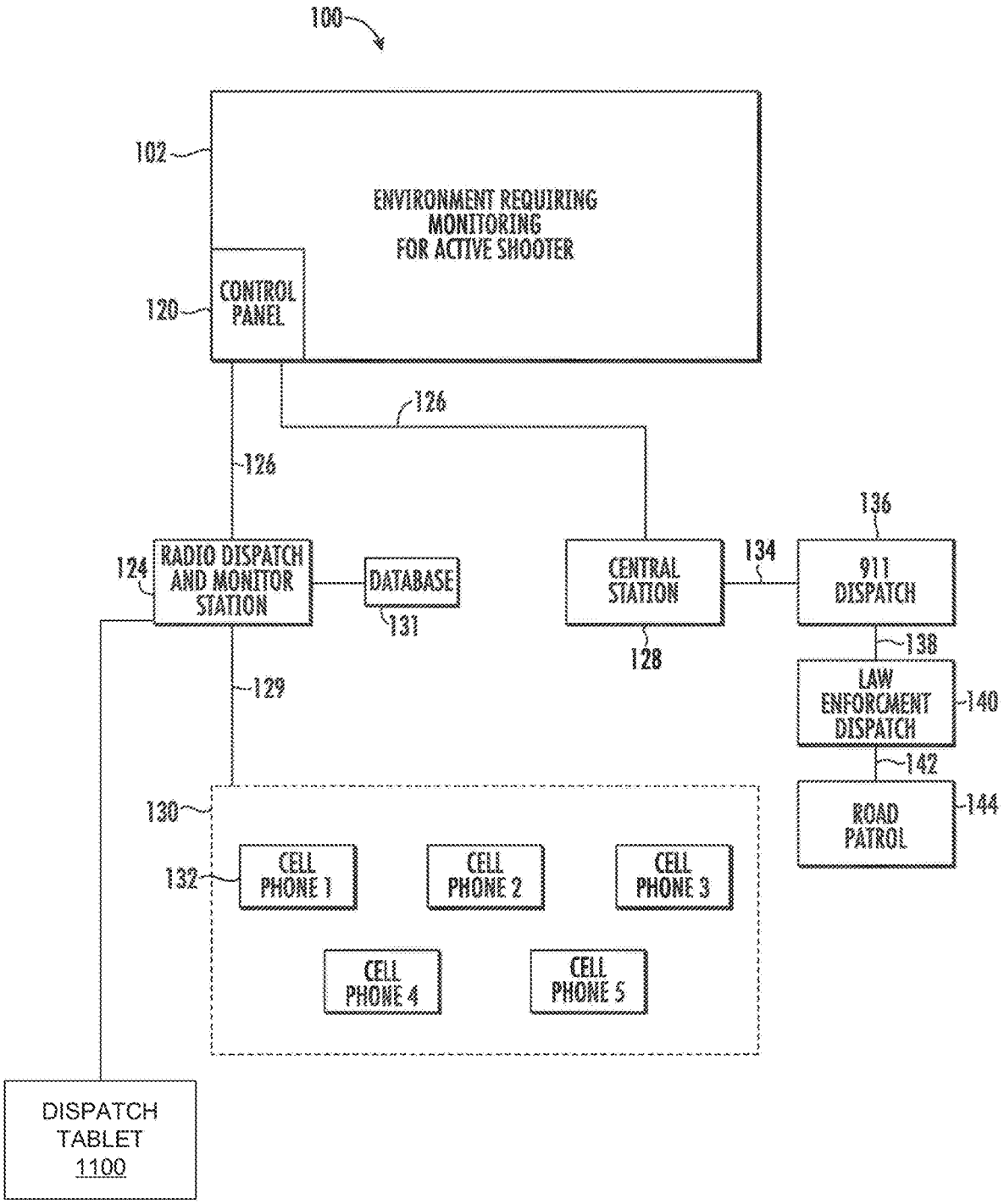
FIG. 17 is an exemplary system block diagram for the dispatch tablet.

FIG. 17 illustrates a system diagram of the alert system showing the notification being sent to the dispatch tablet 1100. FIG. 17 is similar to FIG. 2 but further includes the dispatch tablet. As shown in FIG. 17, the dispatch tablet 17 is in communication with the dispatch and monitor station 124. As discussed above, it will be appreciated that in an alternate embodiment, as discussed above, the tablet may receive notifications directly from the control panel.

The above-described dispatch tablet has several advantages because it provides improved notification to a law enforcement or police dispatch center. No calls are required to notify first responders of the alert or alarm event. Critical information is delivered to law enforcement dispatch within seconds of an alert button being activated at a facility, allowing first responders to dispatch within seconds, not minutes, of the alert button being activated.

Figure 18:
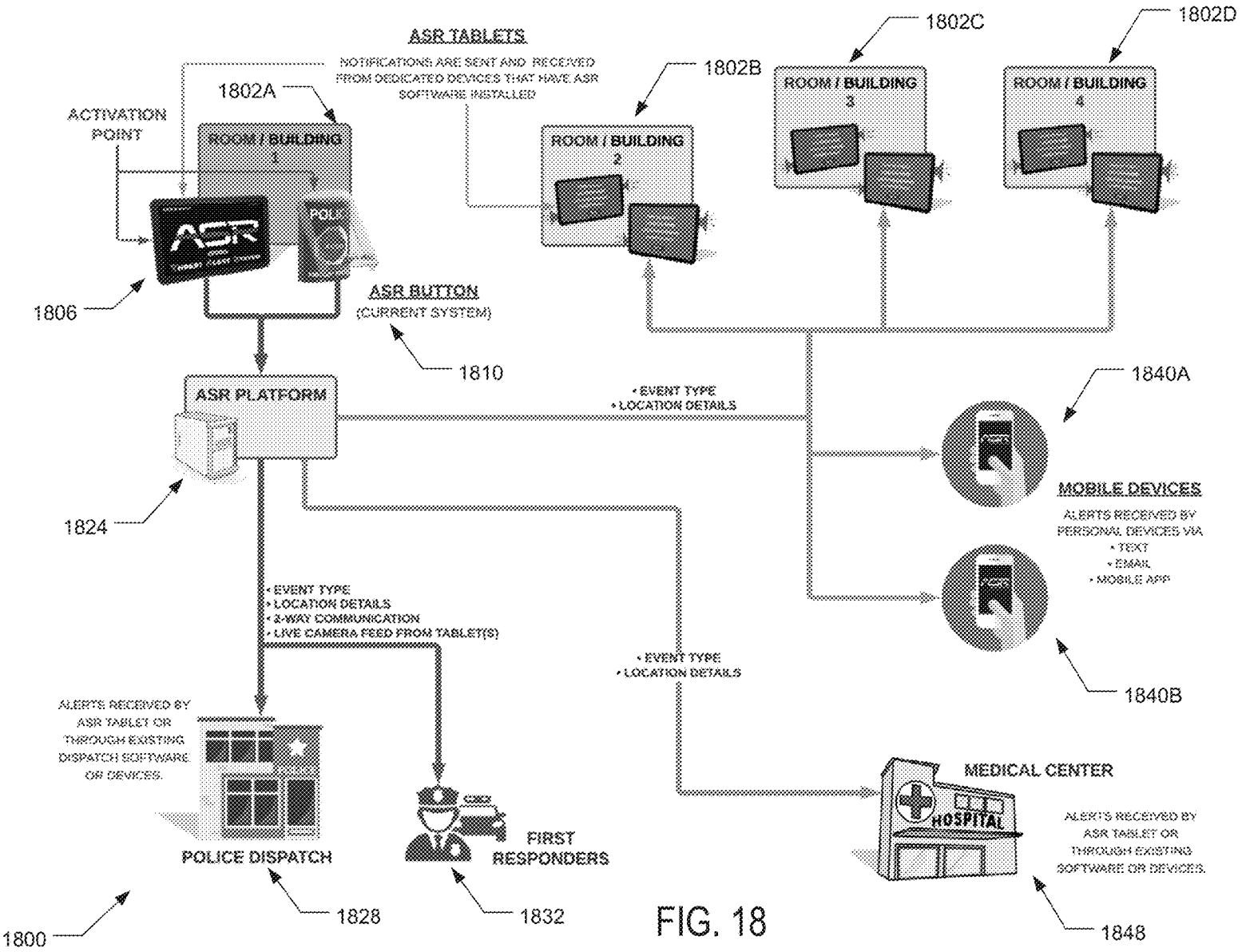
FIG. 18 is an exemplary system and flow diagram illustrating an exemplary system and method for activating an alarm and delivering notifications of the alarm in accordance with one embodiment of the invention.

FIG. 18 is an exemplary system and flow diagram illustrating an exemplary system and method for activating an alarm and delivering notifications of the alarm in accordance with one embodiment of the invention. This system can be referred to as, for example, a crisis management tool, crisis response technology, incident management tool, incident management technology, and the like. These phrases are not intended to be limiting but are exemplary phrases used to describe certain aspects of the features and technology described below with reference to FIG. 18. Exemplary alarms (alert events) and emergencies include but are not limited to, for example, an emergency evacuation, severe weather (e.g., hurricane, tornado), active threat, medical events, theft or other crimes, and the like. Exemplary alert and emergency statuses include but are not limited to, for example, lockdown, lock out, code blue, code red, code orange, and the like. FIG. 18 is similar to FIGS. 2 and 17 but further includes an alert and alarm tablet that permits additional ways in which an alarm event or emergency can be indicated as discussed in further detail below.

An alarm event and emergency response system 1800 contains various hardware components placed at an environment with one or more rooms 1802*a-d*. Although FIG. 18 illustrates four rooms, the building may have fewer or more than four rooms. The environment may include but is not limited to, for example, a commercial business structure, school, federal or state government building, school campus, night club, restaurant, sports arena, movie theater, music venue, hospital, airport, resort, retail mall or any other environment that contains people may be used.

In some embodiments, the operative connection of the hardware components in the alarm event and emergency response system 1800 uses known or future wireless systems and technology, but hardwired systems and technology may also or alternatively be employed.

One or more rooms or locations in the environment include an alert and alarm tablet 1806 and/or a panic button 1810 (or other alert/alarm notification system). As discussed above, the panic button 1810 is typically operatively connected to a control panel, which communicates an alarm event or emergency as discussed herein. Additional details about the alert and alarm tablet 1806 are discussed in further detail with respect to FIGS. 19-26. Additionally or alternatively, an alert and alarm application may be loaded on a computer or mobile phone as a web application and be used to initiate an alarm event or emergency with a key stroke.

In either case, should a user activate an alarm or emergency, a notification is generated. Details about generating notifications using the panic button 1810 are discussed above. When the alarm or emergency is activated with the alert and alarm tablet 1806, software in the alert and alarm tablet, generates a notification that is transmitted. As shown in FIG. 18, the alert and alarm tablet 1806 is transmitted to alert platform 1824. The alert platform 1824 is linked to a one or more electronic devices (e.g., mobile phones) capable of receiving, processing, or displaying said data to one or more first responders 1832. The alert platform 1824 is also linked to a police dispatch 1828 and/other first responder sites. It will be appreciated that there may be one or more additional components between the alert platform 1824 and the police dispatch 1828 as discussed for example with reference to FIG. 2. It will also be appreciated that communications to the first responders 1832 may be alternatively provided by the police dispatch 1828. The alert platform

1824 is also linked to a medical center 1848 to provide medical professionals with information about the alarm event and emergency.

The alert platform 1824 may be, for example, a remote location that has the hardware (electronic devices such as computers or servers with software systems and databases) configured for receiving and processing the data received from other components in the system 1800. The hardware is also configured for transmitting such data to the first responders 1832.

The alert and alarm tablet 1806 may include internal or external components that generate alerts of the alarm event or emergency throughout the environment. For example, the alert and alarm tablet may generate an audible alarm or siren that produces a noise to alert those inside, as well as outside, the building 1802 of a danger. The alert and alarm tablet 1806 may also include a user interface that generates a visual alert (e.g., alternating colors, text, etc.) that provide a visual notification of the alarm event or emergency. The alarm and alert tablet 1806 may also include a camera or other image capture device to capture the environment near the tablet 1806.

The alarm and alert tablet 1806 may also include internal or external sensors (e.g., motion sensor, noise detector, etc.) that may indicate that an alarm is occurring before an activation is received from a human in the facility (i.e., an automated activation).

Once an alarm is activated, other alert and alarm tablets or other security features within the environment or associated with the active shooter response system 1800 may be triggered. For example, the alert and alarm tablet may communicate with the building's PA system, camera/video system, siren system, strobe system, acoustic sensors or other building systems. In addition, individuals within the environment may receive notifications of the alarm event or emergency on their mobile devices 1840*a*-1840*b*.

In addition, individuals working within the building may have a portable panic button or fob that they carry with them to indicate an alarm. The fob can be connected using wireless technology (e.g., Bluetooth) to the alarm and alert tablet 1806 or the control panel to provide a notification of the alarm or emergency as discussed above.

In use, the method begins with an alert event or emergency being activated in the environment. In some embodiments, the alert event or emergency is activated when an individual in the environment presses a panic button 1810, presses an icon on the alert and alarm tablet 1806, and/or presses a fob connected to the alert and alarm tablet 1806 or other controller. In some embodiments, the alert event or emergency is activated using sensors that automatically detect an alarm event or emergency in progress such as by the detection of the sound of a gun shot, the sound of glass breaking, and the like. In yet another embodiment, the alert event or emergency is activated remotely by, for example, an emergency dispatch center.

Details about the communication between the panic button 1810 with the alert platform 1824 are described herein with reference to, for example, FIGS. 2-10 and 17. When the alert event or emergency is activated by an individual pressing an icon on the alert and alarm tablet 1806, software in the alert and alarm tablet 1806 generates a notification and transmits it to the alert platform 1824. Typically, the alert and alarm tablet 1806 communicates with the alert platform using dual-band communication (cellular and IP) for speed and reliability. In one embodiment, the communications include one or more signals sent using a cellular network, such as, for example, LTE, CDMA, CDMA, and other 2G, 3G, 4G and/or 5G communication networks. The communications from the alert and alarm tablet 1806 may include one or more of a short message service (SMS), email, a phone call, a push notification or the like.

The alert platform 1824 is configured to provide rapid notification of the alarm event or emergency in a number of different ways. As discussed for example with reference to FIG. 2, the alert platform 1824 may include a database of cell phone numbers, email addresses, IP addresses or other information for law enforcement personnel, such as police officers in predetermined area, predetermined city or municipality, or county, such that a notification can be sent directly to first responders 1832. Additionally, the alert platform 1824 may send communications to a dispatch center 1828. As discussed in reference to FIG. 17, the alert platform 1824 may provide the notification to a dispatch tablet or other dispatch computer systems or software at, for example, the 911 dispatch center, a law enforcement office, a police station, a police dispatch center, a site security office, Public Safety Answering Points (PSAPS), and/or the like, as discussed in further detail hereinafter. Although FIG. 18 illustrates communications with a police dispatch 1828, it will be appreciated that the notification may go to other law enforcement or security-related dispatch centers. The alert platform 1824 also may provide communication to a medical center 1848 about the event type and location details to prepare for the emergency via a dispatch tablet or existing computer systems or software. The alert platform 1824 may also transmit notifications to other alert and alarm tablets (e.g., 1806*b*-*d*) in the environment and/or mobile devices of individuals at or near the environment (1840*a*-*b*). The alert platform 1824 may include a database with the cell phone numbers, email addresses, IP addresses or other information for the other alert and alarm tablets 1802 and/or mobile devices 1840.

Each of the notifications typically include at least the event type and location details as indicated in FIG. 18. Law enforcement dispatch and first responders may include additional information such as a live camera feed from the alert and alarm tablet(s) or other camera systems at the environment so that they can view video or camera images near the alarm event or emergency. Additionally, law enforcement may also have the ability to provide information to the alert and alarm tablets 1806. It will be appreciated that the notifications may include additional or different information and that the notifications may be updated over time.

As discussed above with reference to FIG. 2, a control panel may also activate other security features at the environment (e.g., strobe light, audible alarm, etc.). Alternatively or additionally, the alert and alarm tablets may also activate alarms and other security systems. For example, when a user icon indicates an alert or emergency, the alert and alarm tablet 1806 may update its user interface display to alternate colors and include text indicating the alarm event or emergency and may generate an audible alarm. Additionally or alternatively, the alert and alarm tablet may be connected to existing security systems to activate a strobe light or audible alarm in the environment. Additionally or alternatively, the alert platform 1824 may cause the security systems at the environment to be activated. For example, the tablets 1806 and/or alert platform may be connected, wirelessly or via wired communication networks, to new or existing PA systems, speaker systems, light/strobe devices, TV's/monitors and the like.

The alert platform 1824 may include software that can determine the nature of the alert or alarm event and respond based on pre-determined rules for responding to different types of alarms or emergencies (e.g., different rules for an active shooter event than a hurricane). Additionally, the alert platform 1824 may include pre-determined rules for responding to different types of alarms or emergencies in different types of environments (e.g., the rules may be different for a school than a stadium). For example, the notifications, recipients, and delivery methods may be customized for different alarm/emergency events and/or different environments. In some embodiments, the alert platform 1824 may be shared by multiple environments; alternatively, each environment may have its own alert platform 1824.

After the alert event or emergency is over, police dispatch 1828 may communicate to the alert platform 1824 which communicates with the alert and alarm tablets 1806 that the emergency is over (e.g., "All Clear").

In some embodiments, the first responders directly or via the police dispatch may have chat discussions with users or victims at one or more of the alert and alarm tablets 1806; additionally or alternatively, the users or victims at one of the alert and alarm tablets may have chat discussions with one or more of the other alert and alarm tablets 1806 and vice versa.

In some embodiments, two-way communication can occur between the first responders, police dispatch and/or alert and alarm tablets 1806 using the camera and display of the alert and alarm tablet.

Figure 19:
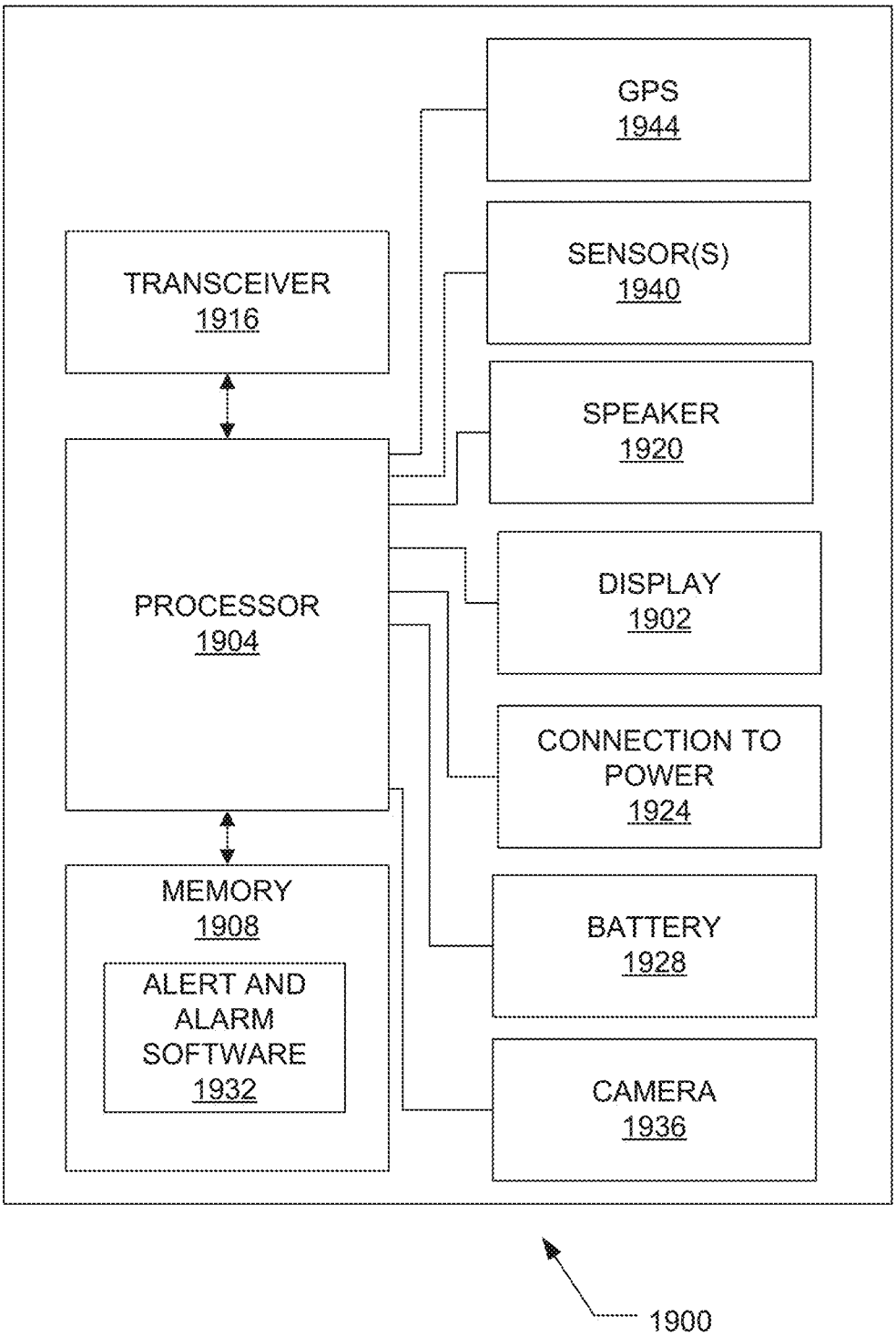
FIG. 19 is a schematic illustration of an alert and alarm tablet in accordance with one embodiment of the invention.

FIG. 19 schematically illustrates an alert and alarm tablet in accordance with embodiments of the invention. The tablet 1900 is configured to be a dedicated stand-alone device that can provide be used to indicate an alarm event and/or provide instant notification of an incident. The tablet 1900 may be located at, for example, a school, hospital, stadium, or other locations where an alarm event or emergency may occur and/or where it is desirable to provide information about an alarm event or other emergency in progress.

As shown in FIG. 19, the tablet 1900 includes a display 1902, a processor 1904, a memory 1908, one or more communications transceiver 1916, a speaker 1920. As shown, for example, in FIG. 19, the transceiver 1916 is coupled to the processor 1904. The memory 1908, speaker 1920 and display 1902 are also coupled to the processor 1904. The display 1904 is also a user interface. The tablet 1900 may further include a connection for an external power supply 1924 and an internal battery 1928. It will be appreciated that the tablet 1900 may include additional components than those illustrated in FIG. 19. An exemplary tablet 1900 that may be used is a Lenovo 10.1, Model No. TB-704A.

The display 1902 may be a touchscreen that enables the user to use a virtual keyboard to type words, numbers, and other characters, and press onscreen icons to activate alarms and provide a user interface to notify individuals of alarms, as discussed herein. Additional details about exemplary user interface icons and touch screen features are described with reference to FIGS. 20-26.

The transceiver 1916 may be a dual-band transceiver (or may include multiple transceivers to allow for dual-band or multi-band communications). In some embodiments, the tablet 1900 includes the transceiver 1916 is a cellular transceiver to communicate over a cellular network without connection to Ethernet. An advantage of using a tablet with a cellular transceiver 1216 is that cellular communications tend to be more secure than Ethernet or other wireless communications and therefore comply with the cyber-security policies of law enforcement agencies. Additionally or alternatively, the tablet 1900 may include a Wi-Fi or other wireless transceiver and/or an Ethernet connector or other wired connectivity to provide communication connectivity to the tablet 1900.

The processor 1904 is configured to operate using alert and alarm software 1932 stored in memory 1908 and executed by the processor 1904 so that the tablet 1900 can be used to indicate an alarm event or emergency in progress and/or function as an alert notification system. The tablet 1900 may also be configured such that it cannot be powered off. In some embodiments, the tablet 1900 is only used for alarm alert and/or notification system. In other embodiments, the tablet 1900 may also be used for other purposes.

As shown in FIG. 19, the tablet 1900 may also include a camera 1936 coupled to the processor 1904 to allow for live video or image capture near the tablet 1900.

The tablet 1900 may also include one or more sensors 1940 coupled to the processor 1904 to allow for automated detection of events that may indicate an alarm or emergency event in progress or to provide additional information to the alert platform 1824 about the alert event or emergency that is occurring. Although the sensor(s) 1940 are shown internal to the tablet 1900 in FIG. 19, it will be appreciated that the sensors may be external to the tablet and connected to the tablet via a wireless (e.g., Bluetooth) or wired connection. Examples of sensor(s) 1940 includes a motion detection sensor, gunshot detector, other acoustic detectors and the like. The alert and alarm software 1932 executed by the processor 1904 can analyze the data from the sensor(s) 1940 to activate an alarm and/or provide additional information about the alarm.

The tablet 1900 may also include a GPS device 1944 (or other geo-location sensor) coupled to the processor 1904 to collect information about the current location of the tablet 1900. The alert and alarm software 1932 executed by the processor 1932 can use the geo-location information to identify a precise location on a map or floor plan to include with the notification provided to the alert platform 1824.

Although the alert and system software 1932 has been described primarily in the context of a tablet, it will be appreciated that the software 1932 may additionally or alternatively, be loaded on a computer or mobile phone as a web application and be used to initiate an alarm event or emergency with a key stroke. In these embodiments, the software would be similarly executed by the processor of the computer or mobile phone and may include all of the features discussed above with respect to the tablet.

In some embodiments, the software 1932 on the tablet 1900 or software on the alert platform 1824 may include the ability to perform facial recognition and provide information based on the facial recognition to police dispatch, first responders and/or other devices at the environment.

Figure 20:
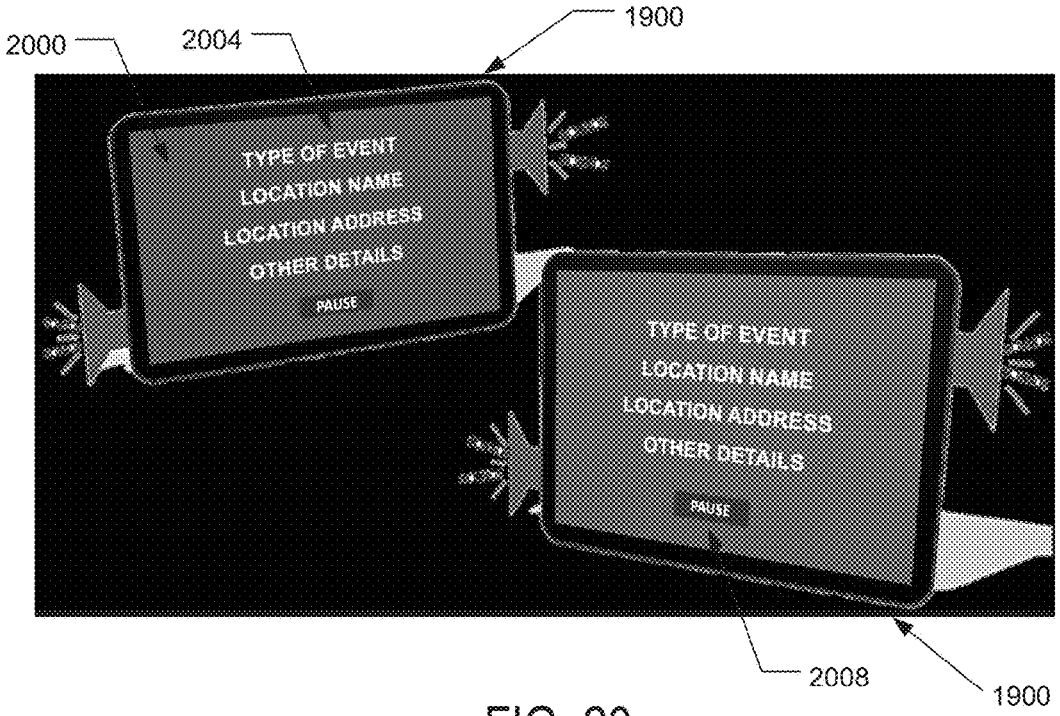
FIG. 20 is an exemplary user interface of alarm screens of the alarm tablet.

FIG. 20 is an exemplary user interface of alarm screens of the alarm tablet. When, the tablet 1900 receives a notification of an alert or alarm event via the transceiver 1916, that alert or alarm event is provided to the processor 1904 which executes the alert and alarm software 1932 to generate an audible and visual alert. For example, the speaker 1920 may issue an audible sound corresponding to the audible alert and the display 1902 may display a notification of the alarm or emergency event corresponding to the visual alert. The notification may include text identifying, for example, the location of the incident and other incident information and portions or all of the information received in the notification may be displayed on the tablet's display 1902. For example, the display 1902 may include the location, name, address and description, so that the information can be relayed to others near the alarm or emergency event. The background color of the display 1902 may also change during an alarm event. For example, the background color of the display 1902 in the kiosk mode may be black, but, during an alarm or emergency event, the background color of the display 1902 may alternate between red and blue. Exemplary illustrations of the user interface 2000 of the display during an alert or alarm event are shown in FIG. 20. It will be appreciated that the background color of the display 1902 may simply change to red, blue, or any other color (and not alternate), that more than two colors may be used and that the interval in which the screen alternates between the two colors may vary. As shown in FIG. 20, the user interface 2000 also includes text 2004 describing the alarm or event based on the received notification, including, for example, the type of event, location name, location address and other details. As shown in FIG. 20, the user interface 2000 may include, a "Pause" icon 2008 to silence the audible sound and stop the display from alternating between red and blue but still display the text 1904. If a new alarm notification is received, then the alarm is activated again, i.e., an audible sound is generated and the display is updated to display the notification information and update the background colors, as discussed above. The alert and alarm software 1932 executing by the processor 1904 may also generate and transmit notifications to send information about the alarm or emergency event to dispatchers and/or first responders, as discussed previously, and/or to other alert and alarm tablets or other emergency notification systems at the site of the alarm event or emergency.

Figure 21:
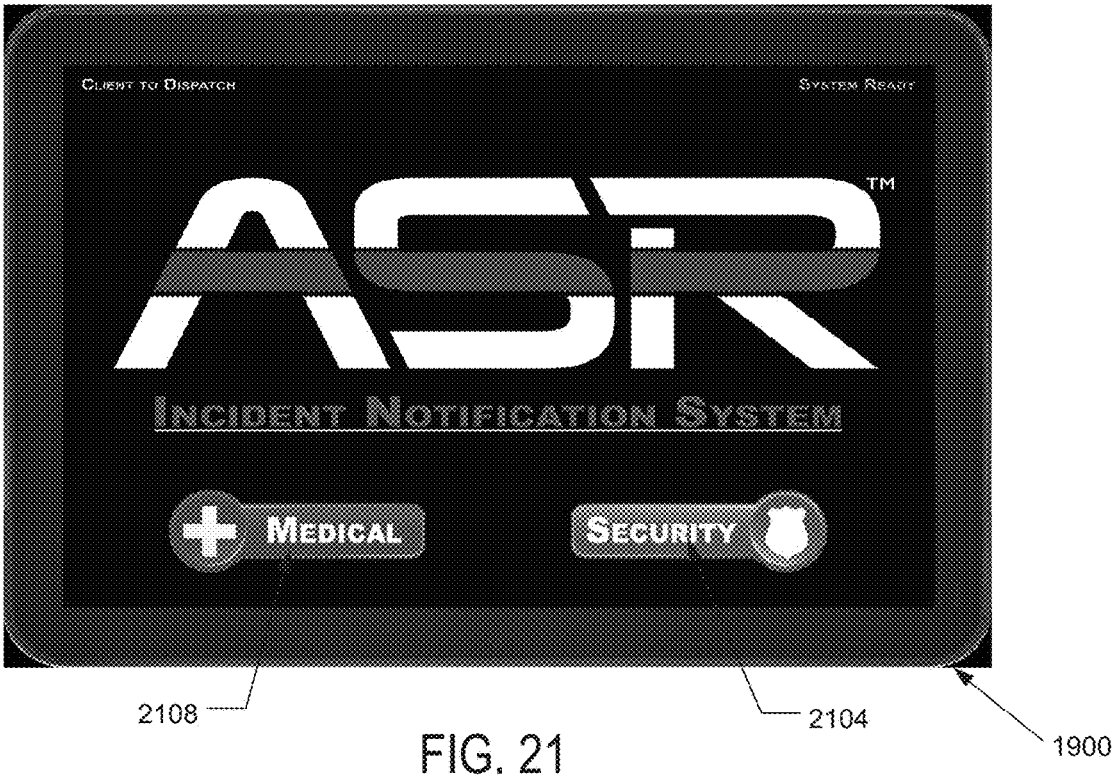
FIGS. 21-26 are exemplary user interface screens of the alarm tablet.
Figure 22:
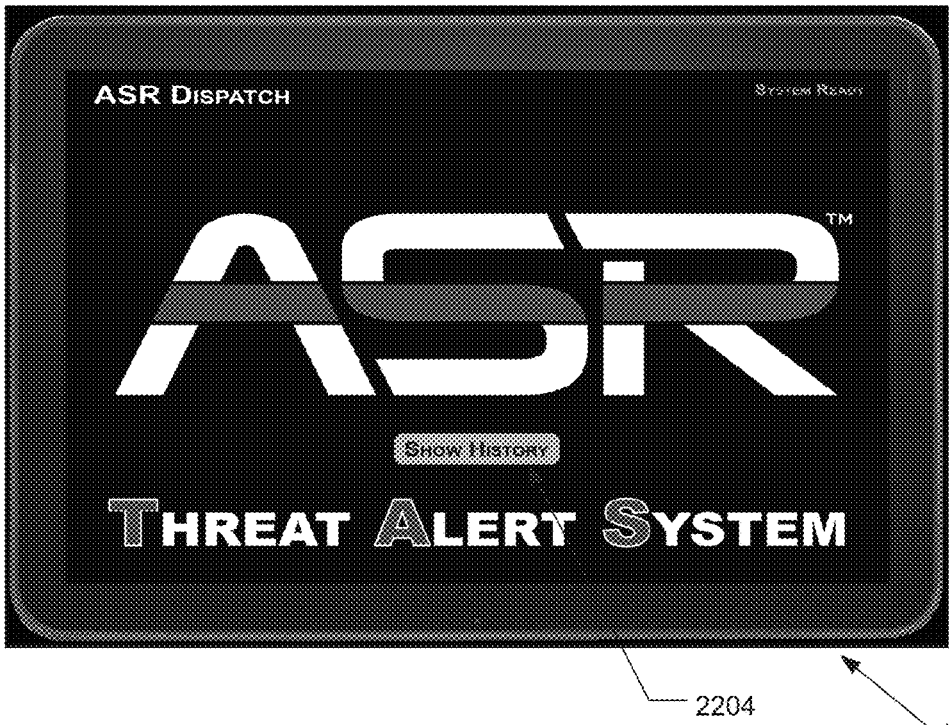
Figure 23:
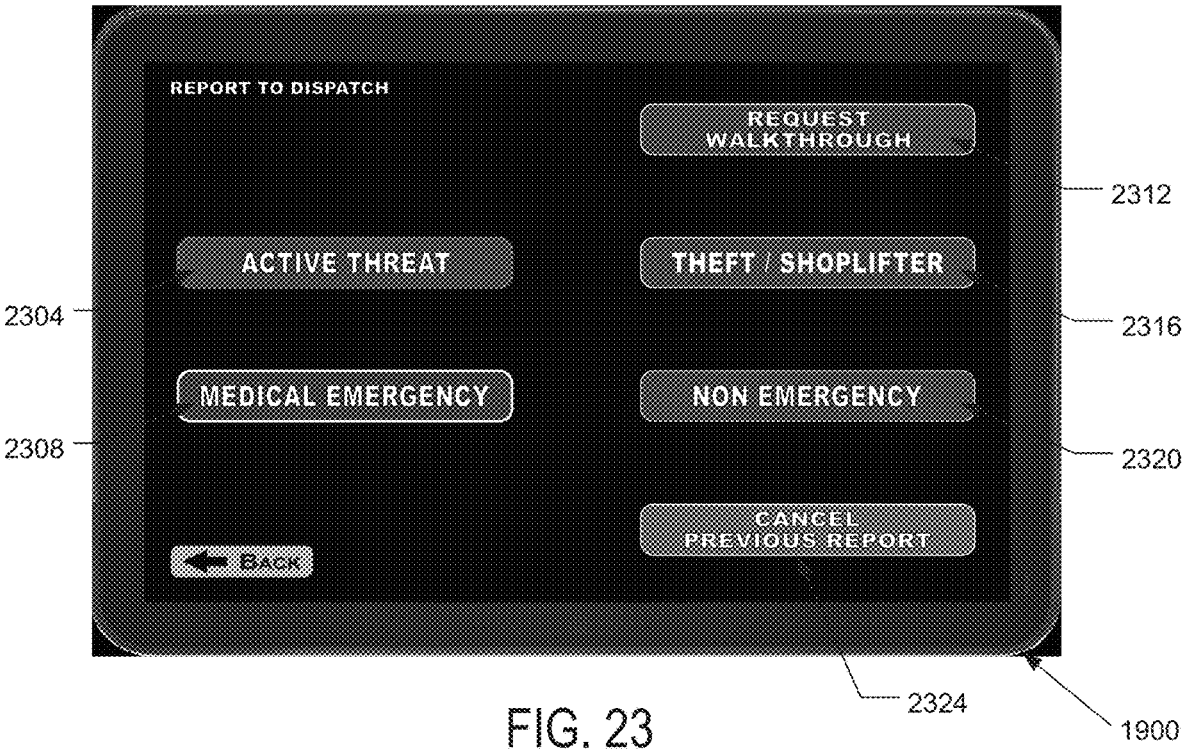
Figure 24:
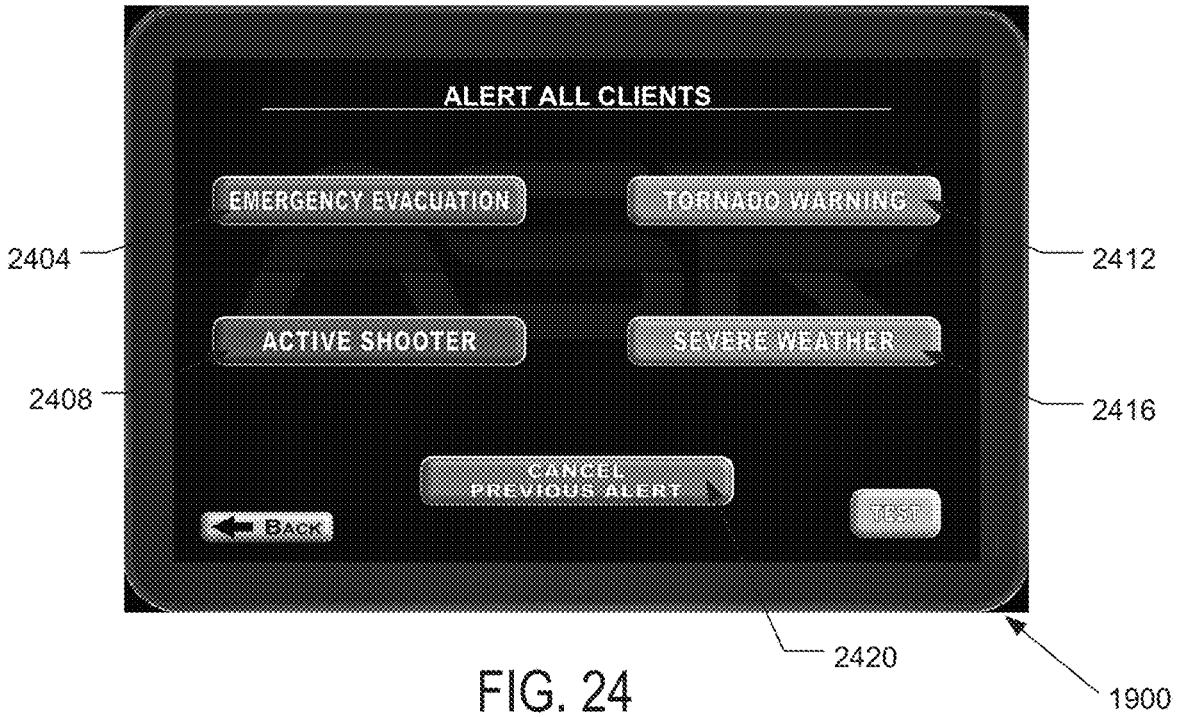
Figure 25:
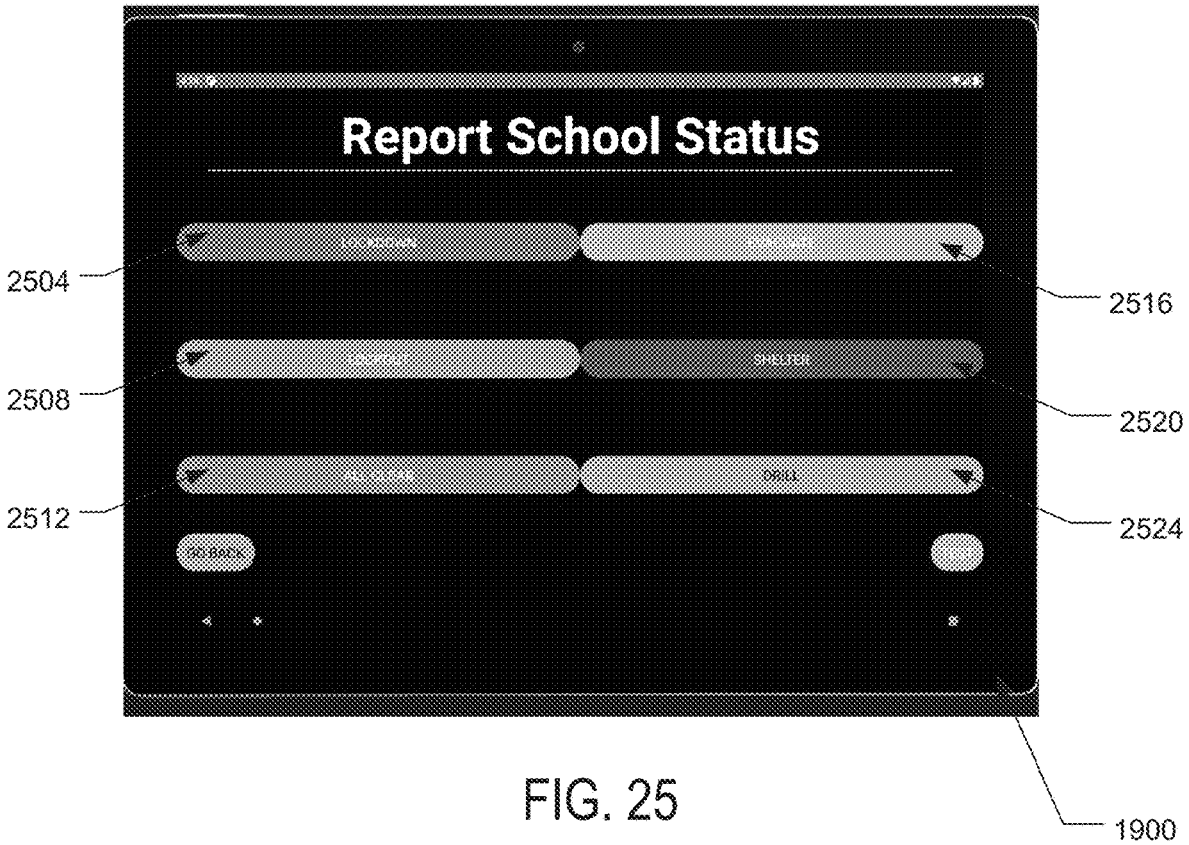
Figure 26:
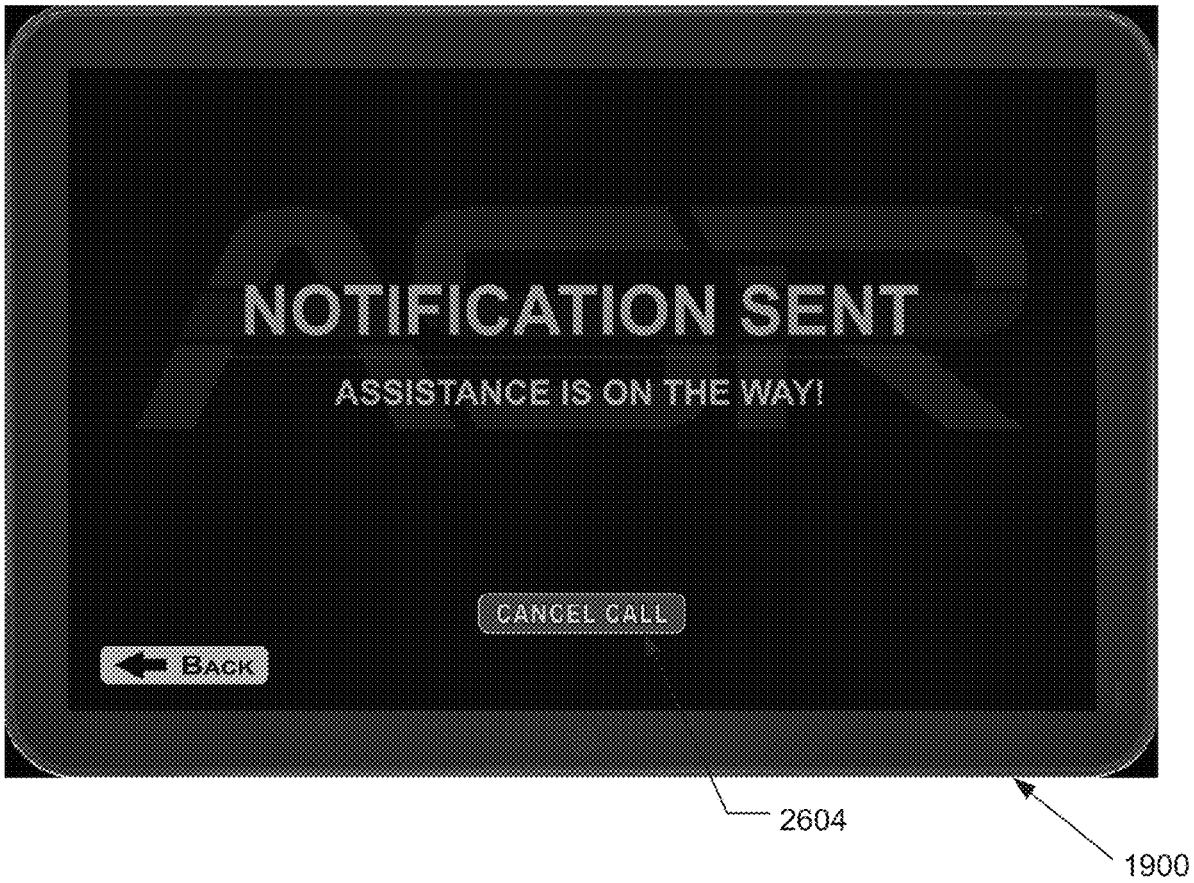

FIGS. 21-26 are exemplary user interface screens of the alarm tablet. It will be appreciated that the user interface screens may be customizable, that buttons and actions can be customized, colors may be customized, text may be customized, and the like, and that FIGS. 21-26 are merely exemplary and may be different than those shown in FIGS. 21-26. As shown in FIG. 21, the user interface of the tablet 1900 may include a security icon 2104 and a medical icon 2108 such that an individual can press either of the icons to indicate either a security or medical emergency. As shown in FIG. 22, the user interface may include a show history icon 2204 such that a history of alarm events or emergencies at that location can be provided as discussed for example with reference to the dispatch tablet above. As shown in FIG. 23, the user interface of the tablet 1900 may include alternative icons to indicate an alarm event or emergency. For example, as shown in FIG. 23, the user interface includes an active threat icon 2304, a medical emergency icon 2308, a request walkthrough 2312, a theft/shoplifter icon 2316 and a non-emergency 2320 which can be selected by an individual to indicate an alert or alarm as discussed above. The user interface may also include a cancel previous report 2324 to allow an individual to cancel an indicated alarm event or emergency. As shown in FIG. 24, the user interface may display other icons including, for example, an emergency evacuation icon 2404, an active shooter icon 2408, a tornado warning 2412 icon, and a severe weather icon 2416. The user interface may also include a cancel previous alert icon 2420 and a test icon. As shown in FIG. 25, an exemplary user interface may include a report school status display that includes a lockdown icon 2504, a lockout icon 2508, an all clear icon 2512, an evacuate icon 2516, a shelter icon 2520 and a drill icon 2524. FIG. 26 illustrates an exemplary user interface of the tablet 1900 for a notification received from, for example, a dispatch center, that indicate the notification has been sent and assistance is on the way. The user interface may also include a cancel call icon 2604. As discussed above and understood by persons of skill in the art, the selection of an icon in the user interfaces results in execution of software routines in for example the alert and alarm software 1932 that result in additional actions as discussed above.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method comprising:

directly receiving a notification that corresponds to an activation of an alert and alarm tablet at a site, wherein the site includes a plurality of other alert and alarm tablets, wherein the notification includes a location of the alert and alarm tablet at the site during the activation of the alert and alarm tablet; and in response to directly receiving the notification, causing a plurality of relay notifications to be received at the plurality of other alert and alarm tablets, wherein the plurality of relay notifications include the location of the alert and alarm tablet at the site during the activation of the alert and alarm tablet, wherein the alert and alarm tablets are configured to be used only as alert and alarm tablets.

2. The method of claim 1, further comprising:

receiving video images from the site and providing the video images to first responders, wherein causing the plurality of relay notifications to be received at the plurality of other alert and alarm tablets includes:

prompting the activated alert and alarm tablet with an identity verification request, and in response to the identity verification request being satisfied, causing the plurality of relay notifications to be received.

3. The method of claim 2, wherein satisfying the identity verification request includes comparing an Internet Protocol (IP) address assigned to the activated alert and alarm tablet with a list of preapproved IP addresses.

4. The method of claim 1, further comprising: receiving information from one or more sensors at or near the alert and alarm tablet.

5. The method of claim 1, wherein the relay notifications are provided directly to first responders located geographically near the site.

6. A tablet comprising:

a processor;

memory coupled to the processor;

a transceiver coupled to the processor, a display coupled to the processor, the display comprising a user interface;

a speaker coupled to the process; and alert and alarm software stored in the memory and configured to be executed by the processor in response to an alarm being activated with the user interface at a site, wherein the processor is configured to generate a notification of the alarm and transmit the notification of the alarm to an alert platform using the transceiver, wherein the tablet is configured such that the user interface cannot be manipulated from a kiosk screen while the alarm is not activated, wherein the tablet is configured to directly communicate the notification of the alarm to other alert and alarm tablets at the site.

7. The tablet of claim 6, wherein the processor is further configured to generate an auditory alarm and cause the speaker to output the auditory alarm, and generate a visual alarm and cause the display to display the visual alarm.

8. The tablet of claim 6, wherein the tablet is configured such that it cannot be selectively powered off by interacting with the tablet.

9. The tablet of claim 6, further comprising an acoustic tester coupled to the processor, wherein the processor is configured to activate the alarm in direct response to receiving specific data values from the acoustic tester.

10. The tablet of claim 7, wherein the visual alarm comprises text comprising information regarding the occurrence of an active shooter emergency at a site and a location of the site.

11. The tablet of claim 6, further comprising a camera coupled to the processor and configured to record live video near the tablet, wherein the processor is configured to: use the camera to perform facial recognition.

12. The tablet of claim 6, wherein the processor is configured to:

deactivate the alarm; and use the user interface to facilitate discussion between individuals located at the site and one or more remote individuals.

13. The tablet of claim 6, further comprising a sensor coupled to the processor and configured to sense alarm event data, wherein the processor is configured to activate the alarm in direct response to receiving specific alarm event data from the sensor.

14. A system comprising:

a plurality of alert and alarm tablets at a site, wherein the plurality of alert and alarm tablets are configured to be activated, wherein the plurality of alert and alarm tablets are configured to generate a notification that comprises a location of an activated one of the plurality of alert and alarm tablets at the site during the activation of the alert and alarm tablet; and an alert platform configured to:

receive the notification from the activated one of the plurality of alert and alarm tablets, issue an identity verification request to the activated one of the plurality of alert and alarm tablets, and processing the received notification in response to the identity verification request being satisfied, wherein the notification comprises alarm event data including at least a location of the site and a location of the activated one of the plurality of alert and alarm tablets in the site, wherein the plurality of alert and alarm tablets are configured to be used only as alert and alarm tablets, wherein the activated one of the plurality of alert and alarm tablets is configured to directly communicate the notification with other of the plurality of alert and alarm tablets at the site.

15. The system of claim 14, further comprising a plurality of panic buttons at the site.

16. The system of claim 15, wherein the plurality of panic buttons are mechanical buttons, wherein the plurality of panic buttons each comprise a fixed panic button or a portable panic button.

17. The system of claim 14, wherein the alert platform further sends information regarding the alarm event data to a plurality of first responders.

18. The system of claim 14, wherein the alarm event data further comprises information identifying the alarm as an active shooter emergency.

19. The system of claim 14, wherein the plurality of alert and alarm tablets comprises a speaker, and wherein at least one of the plurality of alert and alarm tablets outputs an auditory alarm.

20. The system of claim 14, wherein the plurality of alert and alarm tablets comprise a display, each display showing a logical button on a kiosk screen, wherein selecting a logical button activates the respective alert and alarm tablet.

21. The system of claim 14, wherein the plurality of alert and alarm tablets comprises a display that is configured to display text comprising information describing the alarm event data.

22. The system of claim 14, wherein the alert platform further sends information regarding the alarm event data to a law enforcement dispatch.

23. The system of claim 14, wherein the alert platform further sends information regarding the alarm event data to one or more alert and alarm tablets near the activated one of the plurality of alert and alarm tablets.

24. The system of claim 14, wherein the alert platform further sends information regarding the alarm event data to a plurality of mobile devices of individuals near the activated one of the plurality of alert and alarm tablets.

* * * * *